US006674423B2

(12) United States Patent
Isozaki

(10) Patent No.: US 6,674,423 B2
(45) Date of Patent: Jan. 6, 2004

(54) DRIVE UNIT AND LIQUID CRYSTAL DEVICE

(75) Inventor: Shingo Isozaki, Suwa (JP)

(73) Assignee: Epson Corporation, Tokyo (JP)

( * ) Notice: Subject to any disclaimer, the term of this patent is extended or adjusted under 35 U.S.C. 154(b) by 202 days.

(21) Appl. No.: 09/765,311

(22) Filed: Jan. 19, 2001

(65) Prior Publication Data

US 2003/0197706 A1 Oct. 23, 2003

Related U.S. Application Data

(63) Continuation of application No. 09/508,220, filed as application No. PCT/JP99/03726 on Jul. 9, 1999, now abandoned.

(30) Foreign Application Priority Data

Jul. 9, 1998 (JP) ..... 10-194846

(51) Int. Cl.[7] ..... G09G 3/36

(52) U.S. Cl. ..... 345/100; 345/534; 345/535; 345/564

(58) Field of Search ..... 345/87–89, 98–100, 345/211–213, 204, 534, 535, 564; 365/185.23, 185.25, 189.05, 230.01; 235/492

(56) References Cited

U.S. PATENT DOCUMENTS 5,532,965 A * 7/1996 Kenney ..... 365/200
5,903,283 A * 5/1999 Selwan et al. ..... 345/535
6,137,466 A * 10/2000 Moughanni et al. ..... 345/100
6,191,768 B1 * 2/2001 Imamura ..... 345/204
6,222,518 B1 * 4/2001 Ikeda et al. ..... 345/100
6,275,207 B1 * 8/2001 Nitta et al. ..... 345/89
6,384,807 B1 * 5/2002 Furuhashi et al. ..... 345/87
6,449,692 B1 * 9/2002 Krueger et al. ..... 711/122

* cited by examiner

*Primary Examiner*—Regina Liang
*Assistant Examiner*—Francis Nguyen
(74) *Attorney, Agent, or Firm*—Hogan & Hartson, LLP

(57) ABSTRACT

It is an object to provide a drive unit capable of properly responding to an access request from a microprocessor side and an access request from a display section side, and further of realizing a high-speed operation and a low power consumption operation. When an MPU access request from an MPU side and an LCD access request from an LCD side take place, an arbitration circuit (160) makes arbitration to start an access operation to a RAM (100) according to one of the access requests. Additionally, a memory access monitor signal /BUSY for monitoring an access state to the RAM is outputted to an external terminal to be inputted to a hardware wait control terminal of the MPU. The arbitration circuit starts the access operation on condition that a RAM precharge operation reaches completion. The MPU sets a start address and an end address on a column and a page and issues a writing start command, whereupon display data in a display area is rewritten automatically. If a competition occurs between the MPU access request and the LCD access request, the MPU gives the priority to the MPU access request at all times.

30 Claims, 25 Drawing Sheets

1
2
160
161
162
320
a1 b1 c1 d1 e1 f1 g1 h1
a2 b2 c2 d2 e2 f2 g2 h2
a160 b160 c160 d160 e160 f160 g160 h160
a161 b161 c161 d161 e161 f161 g161 h161
a162 b162 c162 d162 e162 f162 g162 h162
a320 b320 c320 d320 e320 f320 g320 h320
K3
LIQUID CRYSTAL DISPLAY PANEL
1 2 3 4 5 6 7 8 240
SIMULTANEOUS SELECTION
SIMULTANEOUS SELECTION
K1
K2

COLUMN DIRECTION
K6
(0)
(1)
1 2 3 4 5 6 7 8 9 10 11
a1 e1 b1 f1 c1 g1 d1 h1 a2 e2 b2
K4
K5
(159) COLUMN ADDRESS
1273 1274 1275 1276 1277 1278 1279 1280
a160 e160 b160 f160 c160 g160 d160 h160
RAM OF SIGNAL LINE DRIVER 22
(0) 1
(1) 2
(29) 30
K7
K8
PAGE DIRECTION
PAGE ADDRESS

CONVENTIONAL TECHNIQUE

THIS EMBODIMENT

FIG.24

| INPUT SIGNAL | | | | | AFTER CONVERSION | | | LO0 | LO1 |
|---|---|---|---|---|---|---|---|---|---|
| IC9 | IC8 | IC7 | IC6 | IC5 | CA7 | CA6 | CA5 | | |
| L | L | L | L | L | L | L | L | L | L |
| L | L | L | L | H | L | L | H | L | L |
| L | L | L | H | L | L | H | L | L | L |
| L | L | L | H | H | L | H | H | L | L |
| L | L | H | L | L | H | L | L | L | L |
| L | L | H | L | H | L | L | L | L | H |
| L | L | H | H | L | L | L | H | L | H |
| L | L | H | H | H | L | H | L | L | H |
| L | H | L | L | L | L | H | H | L | H |
| L | H | L | L | H | H | L | H | L | H |
| L | H | L | H | L | L | L | L | H | L |
| L | H | L | H | H | L | L | H | H | L |
| L | H | H | L | L | L | H | L | H | L |
| L | H | H | L | H | L | H | H | H | L |
| L | H | H | H | L | H | L | H | H | L |
| L | H | H | H | H | L | L | L | H | H |
| H | L | L | L | L | L | L | H | H | H |
| H | L | L | L | H | L | H | L | H | H |
| H | L | L | H | L | L | H | H | H | H |
| H | L | L | H | H | H | L | H | H | H |

DRIVE UNIT AND LIQUID CRYSTAL DEVICE

This is a continuation of application Ser. No. 09/508,220, abandoned, which was a national stage application of International Application No. PCT/JP99/03726, filed Jul. 9, 1999.

BACKGROUND OF THE INVENTION

1. Field of the Invention

The present invention relates to a drive unit and a liquid crystal device using the same drive unit. More particularly, the invention relates to a drive unit having a memory for storing display data from a microprocessor unit and to a liquid crystal device using the same drive unit.

2. Background Art

So far, as a signal line driver (drive unit) applicable to liquid crystal device, there has been known a signal line driver which internally incorporates a memory for storing display data. The use of this signal line driver enables display of an image through the use of display data in a built-in memory without transferring display data from an external microprocessor unit (which will hereinafter be referred to suitably as an MPU) on occasion; therefore, the power consumption is considerably reducible in display of static images.

In connection with such a memory-incorporated signal line driver (column driver), there exists an MPU access request (first access request) forming a request for access to a memory according to a command from an MPU and an LCD access request (second access request) forming a request for access to a memory according to a displaying operation in an LCD (displaying section). Additionally, the LCD access request takes place in synchronism with periodic timings for liquid crystal display, while the MPU access request is made in asynchronous relation to the liquid crystal display timings. For this reason, there is a possibility that these access requests take place competitively.

One possible solution to such a competition between the access requests is use of a dual-port memory as an incorporated memory of a signal line driver. This dual-port memory has two data ports which are accessible simultaneously. Accordingly, even if the competition between access requests comes about, the read/write operation is achievable properly in the memory.

However, the cell size of such a dual-port memory is extremely larger than that of a single-port memory; in consequence, the use of the dual-port memory as an incorporated memory enlarges a chip area of the signal line driver, thereby increasing the price of the signal line driver.

Meanwhile, as a conventional means utilizing a single-port memory but capable of eliminating the problem in a competition between access requests through contrivance of circuit arrangement, there has been known a technique disclosed in Japanese Unexamined Patent Publication No. 10-105505.

There is a problem arising with this conventional technique, however, in that, when the sum of a processing time of an access operation according to an MPU access request and a processing time of an access operation according to an LCD access request is taken as T, there is a need to set the interval in time between MPU access requests at T, not only at a competition between access requests but also in a non-competitive condition. Hence, difficulty is experienced in realizing high-speed data transfer from an MPU to a signal line driver, and a burden imposed on the MPU increases.

In addition, as conventional techniques regarding a signal line driver incorporating a memory, there have been techniques disclosed in Japanese Unexamined Patent Publication Nos. 10-106254 and 10-105120.

For example, Japanese Unexamined Patent Publication No. 10-106254 discloses a signal line driver capable of rewriting display data in a specified display area.

However, this conventional technique requires that an MPU issues a return command or a writing start command whenever a write address goes beyond an address range in a specified display area, thus leading to an increase in processing load imposed on the MPU. Specifically, in a case in which a liquid crystal display panel has a large screen, this problem becomes serious.

Furthermore, Japanese Unexamined Patent Publication No. 10-105120 discloses the conventional technique in which a monitor circuit monitors whether or not data is read from or written in a memory and, if the read/write thereof is not made from/in the memory, a terminal of an input/output circuit is set at a high-impedance condition.

However, this conventional technique, for its own object, uses only one chip select signal to set an input terminal of an input/output circuit to a high-impedance condition, but it does not achieve an object on speed-up of data transfer or reduction of processing load on an MPU.

SUMMARY OF THE INVENTION

The present invention has been developed in consideration of the aforesaid technical objects, and it is an object of the invention to provide a drive unit and a liquid crystal device which are capable of responding exactly to a first access request from a microprocessor side and a second access request from a displaying section side, and further of realizing a high-speed operation and a low-power-consumption operation.

For this object, in accordance with this invention, there is provided a drive unit which receives display data from a microprocessor unit to drive a displaying section, characterized by comprising a memory for storing display data to be used for image display in the displaying section, an arbitration circuit for receiving a first access request forming a request for access to the memory according to a command from the microprocessor unit and a second access request forming a request for access to the memory according to a displaying operation in the displaying section to arbitrate in priority between the first and second access requests for starting an access operation to the memory according to the preferential one of the first and second access requests, and a circuit for outputting, to an external terminal, a memory access monitor signal for monitoring an access condition of the memory to which an access operation starts in accordance with the arbitration of the arbitration circuit.

According to this invention, upon receipt of the first and second access requests, the arbitration circuit arbitrates in the priority between the first and second access requests. When giving the priority to the first access request, the arbitration circuit starts an access operation according to the first access request. On the other hand, when giving the priority to the second access request, it starts an access operation according to the second access request.

In addition, according to this invention, a memory access monitor signal is outputted to an external terminal of the drive unit for monitoring an access condition to the memory. Accordingly, by means of the measurement of a signal level of this memory access monitor signal or variation timing of the signal level, information as to what arbitration is conducted in the arbitration circuit is obtainable through monitoring from the external. In consequence, for example, it is possible to determine a proper generation timing of the first access request.

Still additionally, this invention is characterized in that, when a competition arises between the first and second access requests, the memory access monitor signal becomes active for at least a processing time for a first access operation according to the first access request plus a processing time for a second access operation according to the second access request. In this way, for example, the determination of a proper generation timing of the first access request or the like becomes feasible by merely measuring the length of time for which the memory access monitor signal is active.

Moreover, this invention is characterized in that the memory access monitor signal is a signal to be outputted through the aforesaid external terminal to a wait terminal of the microprocessor unit. This can prolong the time interval between the first access requests only when a competition between the first and second access requests takes place, while it can shorten the time interval therebetween in the normal condition, thus accomplishing a high-speed data transfer.

Still moreover, this invention is characterized by comprising a first control circuit for outputting a signal indicative of the first access request, a second control circuit for outputting a signal representative of the second access request and a third control circuit for outputting a first operation end signal which becomes active at the completion of a first access operation according to the first access request and a second operation end signal which becomes active at the completion of a second access operation according to the second access request, wherein the memory access monitor signal is produced as a logical sum of a signal which becomes active when the first access request signal becomes active while becoming inactive when the first operation end signal becomes active and a signal which becomes active when the second access request signal becomes active while becoming inactive when the second operation end signal becomes active. This allows the memory access monitor signal for monitoring the memory access condition to be developed easily with a small circuit scale by the effective utilization of circuits of the arbitration circuit or the like.

Furthermore, in accordance with this invention, there is provided a drive unit, which receives display data from a microprocessor unit to drive a displaying section, characterized by comprising a memory for storing display data to be used for image display in the displaying section, an arbitration circuit for receiving a first access request forming a request for access to the memory according to a command from the microprocessor unit and a second access request forming a request for access to the memory according to a displaying operation in the displaying section to arbitrate in priority between the first and second access requests for starting an access operation to the memory according to the preferential one of the first and second access requests, a memory control circuit for conducting a precharge operation for the memory before the start of the access operation to the memory, and decision means for making a decision as to whether or not the memory precharge operation reaches completion, wherein the arbitration circuit starts the memory access operation according to one of the first and second access requests on condition that a decision is made to the completion of the memory precharge operation.

According to this invention, the start of the memory access operation takes place provided that the decision shows the completion of the memory precharge operation. Accordingly, the memory access operation can be started at the most suitable timing, thus exhibiting the maximum of ability of the transistors in the drive unit to the utmost. In consequence, the speed-up of the memory access operation becomes achievable.

Still furthermore, this invention is characterized in that the memory control circuit makes a precharge monitor signal active when a decision is made that the memory precharge operation reaches completion, while the arbitration circuit starts the memory access operation according to the first and second access requests on condition that the precharge monitor signal becomes active. The use of this precharge monitor signal permits the effective utilization of circuits included in the arbitration circuit and the control of the memory access operation or the precharge operation.

In addition, this invention is characterized in that the foregoing decision means includes a dummy memory for making a decision as to whether or not the memory precharge operation reaches completion, and the precharge signal is produced by a logical sum of signals of first and second bit lines in the dummy memory. In this way, the precharge monitor signal can be produced with a small circuit scale.

Moreover, in accordance with this invention, there is provided a drive unit, which receives display data from a microprocessor unit to drive a displaying section. characterized by comprising a memory for storing display data to be used for image display in the displaying section, and an address control circuit for, when the microprocessor unit sets a first start address and a first end address related to a first address, forming one address of a column address and a row address of the memory, for access to a specified display area of the memory and starts an access operation to the memory, automatically varying the first address to return the first address to the first start address on condition that the first address goes beyond the first end address and further varying a second address forming the other address of the column address and the row address.

According to this invention, the microprocessor unit first sets the first start address (a column start address or a row start address) of the first address (the column address or the row address) and the first end address (a column end address or a row end address) and then starts the access operation (a write operation or a read operation) to the memory. Accordingly, the first address varies (increments or decrements) automatically, and when the first address goes beyond the first end address, the first address returns to the first start address, while the second address (the row address or the column address) varies, for example, increment takes place by 1. In this way, the speed-up of writing of the display data in the specified display area or the reading of the display data from the specified display area becomes feasible without considerably increasing the processing load on the microprocessor unit.

In addition, this invention is characterized by including first to Nth drive units, with, when an access operation to a memory of an Mth drive takes place, an operating section of each of the other drive units for use on an access operation to its own memory being made inoperative. This can prevent the useless power consumption in the drives other than the Mth drive, thus realizing a low-power-consumption operation.

Still additionally, this invention is characterized in that the first to Nth drive units include first to Nth column address converting circuits, respectively, and further include first to Nth column address control circuits, respectively, with each of the first to Nth column address convening circuits converting a column address set by the microprocessor unit into a relative address to output the converted relative address to the succeeding column address control circuit and further outputting a control signal for validating or invalidating an output of a column address decoder the column address control circuit includes. This enables a reduction of the circuit scale of the column address decoder, which results in a reduction of the circuit scale of the entire drive unit. Additionally, the invalidation of the output of the column address decoder using this control signal prevents the useless power consumption.

Moreover, in accordance with this invention, there is provided a drive unit which receives display data from a microprocessor unit to drive a displaying section, characterized by comprising a memory for storing the display data from the microprocessor unit and an arbitration circuit for receiving a first access request forming a request for access to the memory according to a command from the microprocessor unit and a second access request forming a request for access to the memory according to a displaying operation in the displaying section to arbitrate in priority between the first and second access requests for starting an access operation to the memory according to one of the first and second access requests, wherein, when a competition occurs between the first and second access requests, the arbitration circuit makes an arbitration to always give, priority to the first access request.

According to this invention, when a competition occurs between the first and second access requests, priority is always given to the first access request on the microprocessor unit side. Accordingly, this does not require complicated processing in which the priority to be given to one of the first and second access requests is determined on the basis of the difference in time between these access requests. In consequence, the simplification of the circuit arrangement of an arbitration circuit is feasible and the arbitration circuit in which less malfunction occurs is realizable.

In addition, this invention is characterized in that, when receiving the first access request after the reception of the second access request but before the completion of a second access operation according to the second access request, the arbitration circuit ceases the second access operation while starting a first access operation according to the first access request, and further resumes the second access operation after the completion of the first access operation. In this way, the second access operation according to the second access request is resumable after the first access operation is conducted on the basis of the priority given to the first access request. This enables appropriate time-division access to the memory.

Still additionally, this invention is characterized in that the arbitration circuit includes a holding circuit for holding reservation information about the resumption of the second access operation when receiving the first access request after the reception of the second access request but before the completion of the second access operation according to the second access request, and the arbitration circuit resumes the second access operation on the basis of the reservation information, the holding circuit retains, after the completion of the first access operation. Thus, the installation of the holding circuit for holding the reservation information enables proper resumption of the second access operation after the completion of the first access operation.

Furthermore, a liquid crystal device according to this invention is characterized by comprising any one of the above-described drive units and a liquid crystal display panel driven by that drive unit. The use of the drive unit according to this invention in this way accomplishes scale reduction, power consumption reduction, speed-up of display processing and other advantages of the liquid crystal device, and further allows the liquid crystal device to cope with the screen enlargement of the liquid crystal display panel.

BRIEF DESCRIPTION OF THE DRAWINGS

FIG. 24 is an illustration for explaining an address conversion in a column address converting circuit.

PREFERRED EMBODIMENTS

A preferred embodiment of the present invention will concretely be described hereinbelow with reference to the drawings.

1. Description of Entire Device

Figure 1:
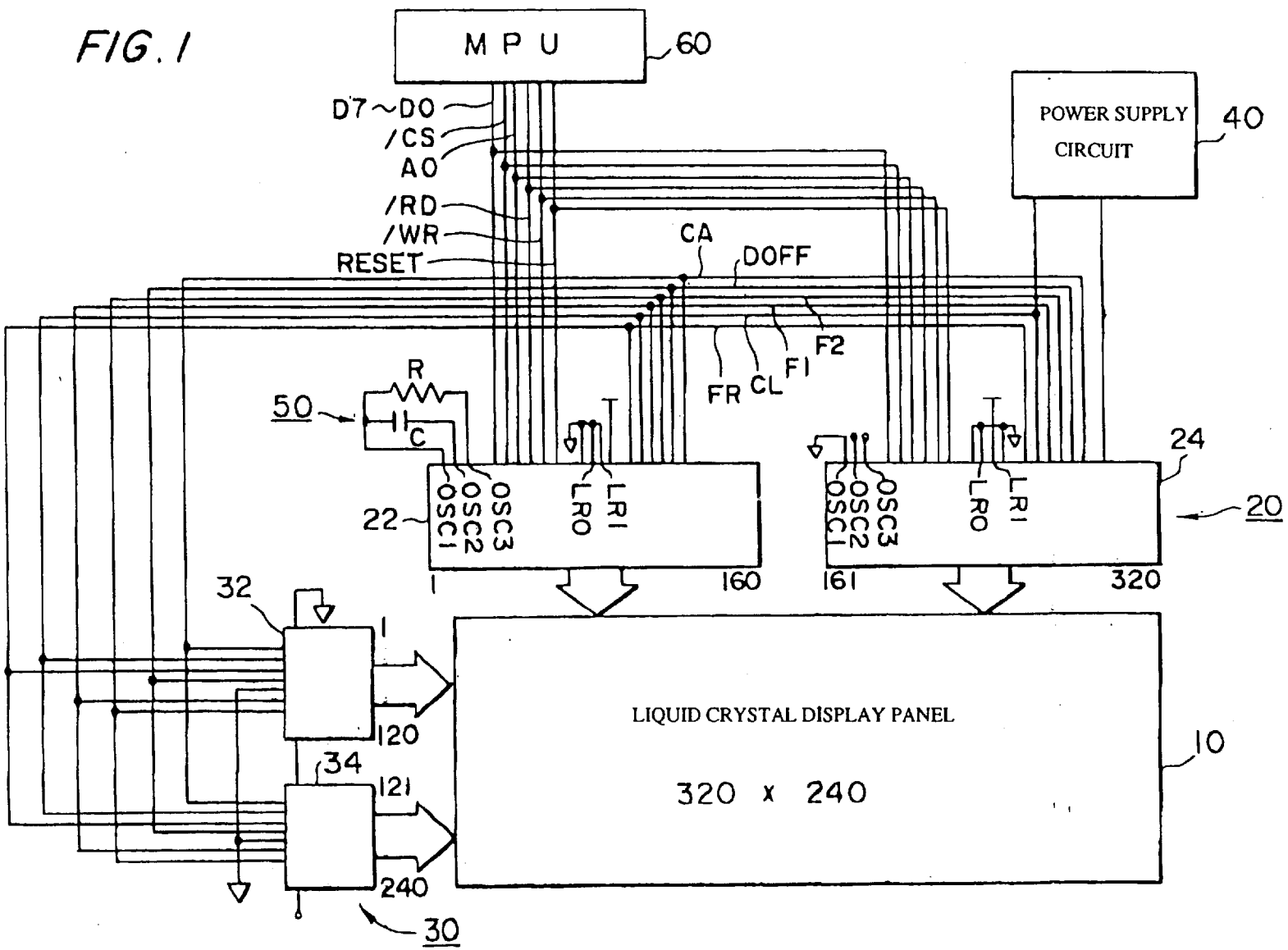
FIG. 1 is a block diagram showing a configuration of a liquid crystal device.

FIG. 1 is an example of an entire illustration of a liquid crystal device including a liquid crystal display panel. This liquid crystal device comprises a signal line driver 20, a scanning line driver 30, a power supply circuit 40 and an oscillation outer circuit 50.

In this configuration, a liquid crystal display panel 10 has, for example, 320×240 pixels. That is, this liquid crystal display panel 10 has 320 signal lines and 240 scanning lines, and a switching element or a liquid crystal layer are disposed at a pixel position corresponding to an intersection of each of the signal lines and each of the scanning lines.

The liquid crystal display panel 10 can be an active matrix type liquid crystal display panel using a three-terminal type switching element such as TFT (Thin Film Transistor) or a two-terminal type switching element such as MIM (Metal Insulator Metal); alternatively, it can be a simple matrix type liquid crystal display panel.

The signal line driver (column driver) 20 is for supplying data signals to the 320 signal lines, and in this embodiment, it is made up of a first signal line driver (signal line drive IC) 22 and a second signal line driver 24. The first signal line driver 22 supplies data signals to the first to 160th signal lines, while the second signal line driver 24 supplies data signals to the 161st to 320th signal lines. These first and second signal line drivers 22 and 24 have the same configuration.

In this embodiment, a maximum of four signal line drivers can make a cascade connection. Additionally, this connecting arrangement can drive a maximum of 160×4 (=640) signal lines.

Each of the signal line drivers is equipped with two external terminals LR0 and LR1. Through the variation of a combination of electric potentials to be applied to these external terminals LR0 and LR1, the maximum of four signal line drivers cascade-connectable can be used properly at the first to fourth stages.

For example, in FIG. 1, the terminals (LR0, LR1) of the first-stage first signal line driver 22 are set at (L, L) levels, while the terminals (LR0, LR1) of the second-stage second signal line driver 24 are set at (L, H) levels.

Incidentally, in a case in which third and fourth signal line drivers are installed at the third and fourth stages, respectively, the terminals (LR0. LR1) of the third-stage third signal line driver are set to (H, L) levels, while the terminals (LR0, LR1) of the fourth-stage fourth signal line driver are set to (H, H) levels.

The scanning line driver (row driver) 30 is for supplying scanning signals to the 240 scanning lines, and in this embodiment, it is made up of a first scanning line driver 32 and a second scanning line driver 34. The first scanning line driver 32 supplies scanning signals to the first to 120th scanning lines, while the second scanning line driver supplies scanning signals to the 121st to 240th scanning lines.

Various types of power supply voltages are applied from the power supply circuit 40 to the signal line driver 20 and the scanning line driver 30, and a microprocessor unit (MPU) 60 issues various kinds of commands and supplies various kinds of data.

2. Description of Signal Line Driver

Figure 2:
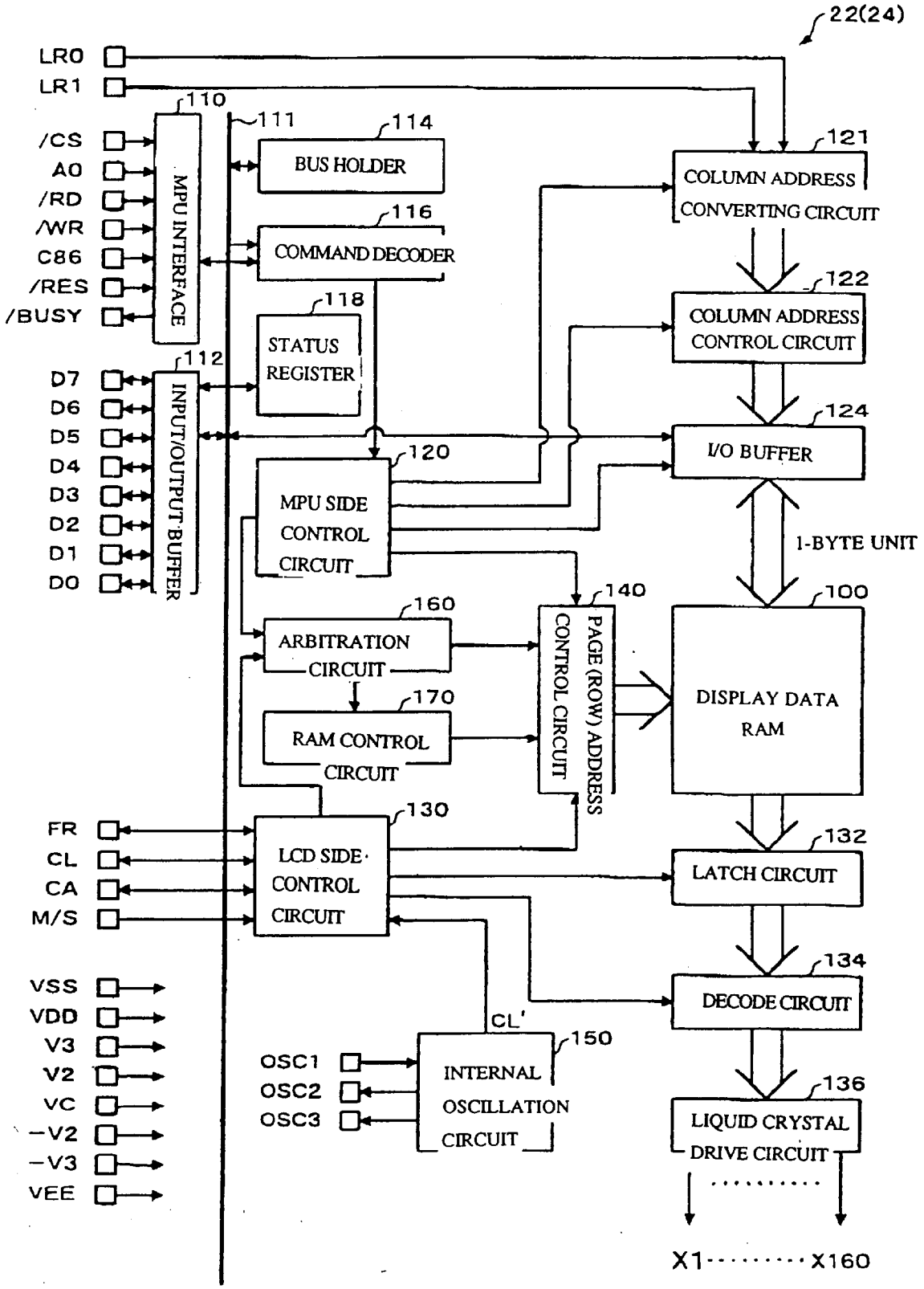
FIG. 2 is a block diagram showing a configuration of a signal line driver.

Referring to FIG. 2, a detailed description will be given hereinbelow of the first and second signal line drivers (signal line drive ICs) 22 and 24 having the same configuration.

First, the description starts at each of the terminals (signals) of the signal line drivers. In the following description, a symbol "/" depicts a terminal (signal) which gets into an active condition at an L level.

(1) D7 to D0

These represent an 8-bit two-way data bus terminal, which is connected to an 8-bit or 16-bit standard MPU data bus.

(2) LR0, LR1

These designate terminals for using properly a maximum of four signal line drivers, cascade-connectable, at the first to fourth stages as mentioned above.

(3) /CS

This denotes a chip select terminal. In this embodiment, the MPU recognizes a plurality of signal line drivers as one signal line driver, with one chip select signal being inputted in common to a plurality of signal line drivers. Accordingly, when the MPU sets the chip select signal at an L level (active), in all the signal line drivers, the input/output of data through the D7 to D0 becomes possible. On the other hand, when the MPU sets the, chip select signal at an H level (inactive), in all the signal line drivers, D7 to D0 are set to a high-impedance condition.

(4) A0

This signifies a terminal to which the least significant bit of the address bus of the MPU is connected. When A0 is at an L level, this indicates that D7 to D0 are a command (control data). On the other hand, when A0 is at an H level, this indicates that D7 to D0 are display data.

(5) /RD, /WR, C86, /RES

These /RD, /WR and C86 designate terminals to be used properly between the connection of an 80-series MPU and the connection of a 68-series MPU, and they receive a signal for determining a read/write timing or the like.

(6) /BUSY

This means a terminal for a memory access monitor signal which is for monitoring an access condition to a display data RAM 100 (which will hereinbelow be referred to properly as a RAM). When /BUSY is an L level, this signifies that the access operation to the RAM 100 is progressing. On the other hand, when it is at an H level, this signifies that the access operation thereto is not progressing.

(7) M/S

This denotes a terminal for selection between a master operation and a slave operation in a plurality of signal line drivers connected in a cascade fashion. The signal driver conducts the master operation when M/S is an H level, while performing the slave operation when M/S is an L level. Commonly, when M/S of the first-stage signal line driver is set at the H level, while M/S of the second-stage and following signal line drivers are set at the L level. The signal line driver, conducting the master operation, outputs a signal needed for liquid crystal display, and the signal line driver, conducting the slave operation, receives the signal needed for the liquid crystal display, thereby establishing the synchronism in the liquid crystal display.

(8) FR, CL, CA

These FR, CL and CA depict input/output terminals for a liquid crystal alternating-current signal, a display clock signal and a field start signal, respectively, with the output of these signals taking place when the signal line driver conducts the master operation, while the input thereof takes place when the signal line driver conducts the slave operation.

(9) OSC1 to OSC3

These signify terminals to be used for an oscillating operation of an internal oscillation circuit 150. As shown in FIG. 1, in the first-stage signal line driver 22 conducting the master operation, its terminals OSC1 to OSC3 are connected to the oscillation outer circuit 50, comprising a resistor R and a capacitor C. Thus, a clock CL' having a frequency of $f=1/(2.2\times C\times R)$ (Hz) is created and outputted to an LCD side control circuit 130. Additionally, this is used as a reference clock for LCD display. In the second-stage and succeeding signal line drivers conducting the slave operation, the internal oscillation circuit 150 is not put into operation, so that a clock inputted through the terminal CL is put to use.

Furthermore, a description will be given hereinbelow of a function of each of the blocks shown in FIG. 2.

A bus holder 114 is for holding data on a bus 111 temporarily. A command decoder 116 decodes a command inputted from the MPU through an MPU interface 110 and communicates the decoding result to the MPU side control circuit 120. A status register 118 holds status information on the signal line drivers.

The MPU side control circuit 120, on the basis of the command decoding result in the command decoder 116, controls a column address converting circuit 121, a column address control circuit 122, an I/O buffer 124 and a page (row) address control circuit 140 to read/write display data from/in the RAM 100 in units of byte. The display data to be read/written from/in is inputted/outputted through the input/output buffer 112 in/from the I/O buffer 124.

The LCD side control circuit 130, on the basis of an LCD display clock CL (or CL'), controls a page address control circuit 140 and latch circuit 132 to read out display data corresponding to four lines from the RAM 100 and then to make the latch circuit 132 latch that display data. A decode circuit 134 decodes the latched display data under the control of the LCD side control circuit 130. A liquid crystal drive circuit 136 supplies data signals to the signal lines of the liquid crystal display panel on the basis of the decoded display data.

The MPU side control circuit 120, when an MPU access request signifying an access request according to a command from the MPU takes place, informs an arbitration circuit 160 of that request. Likewise, the LCD side control circuit 130, when an LCD access request representing an access request according to a display operation in the LCD takes place, communicates that request to the arbitration circuit 160.

The arbitration circuit 160 receives the aforesaid MPU access request and the aforesaid LCD access request to make arbitration about which of these access requests is accepted preferentially. Additionally, the arbitration circuit 160 controls a RAM control circuit 170 or the page address control circuit 140, to start an access operation to the RAM 100, according to the accepted one of these access requests.

The page address control circuit 140 has a page (row) address decoder and makes one word line of the RAM 100 active on the basis of a page address from one of the MPU side control circuit 120 and the LCD side control circuit 130.

3. Liquid Crystal Display Panel and RAM Address Space

In this embodiment, the signal line drivers drive the liquid crystal display panel by means of a MLS (Multi Line Selection) drive for a simultaneous four-line selection. This MLS drive is a driving method of concurrently selecting a plurality of scanning lines (four in this embodiment). That is, a conventional line-sequential drive has only one selection period within one frame. For this reason, the lime interval between one selection period and the next selection period is prolonged so that the transmittance radio of the liquid crystal decreases with the passage of time, thereby impairing the contrast. On the other hand, in the case of the MLS drive, because of the simultaneous selection of a plurality of scanning lines, it is possible to set a plurality of selection periods within one frame term, which can shorten the time interval between one selection period and the next selection period so that the decrease in the transmittance of the liquid crystal can be restrained and the contrast can be improved.

Figures 3A, 3B:
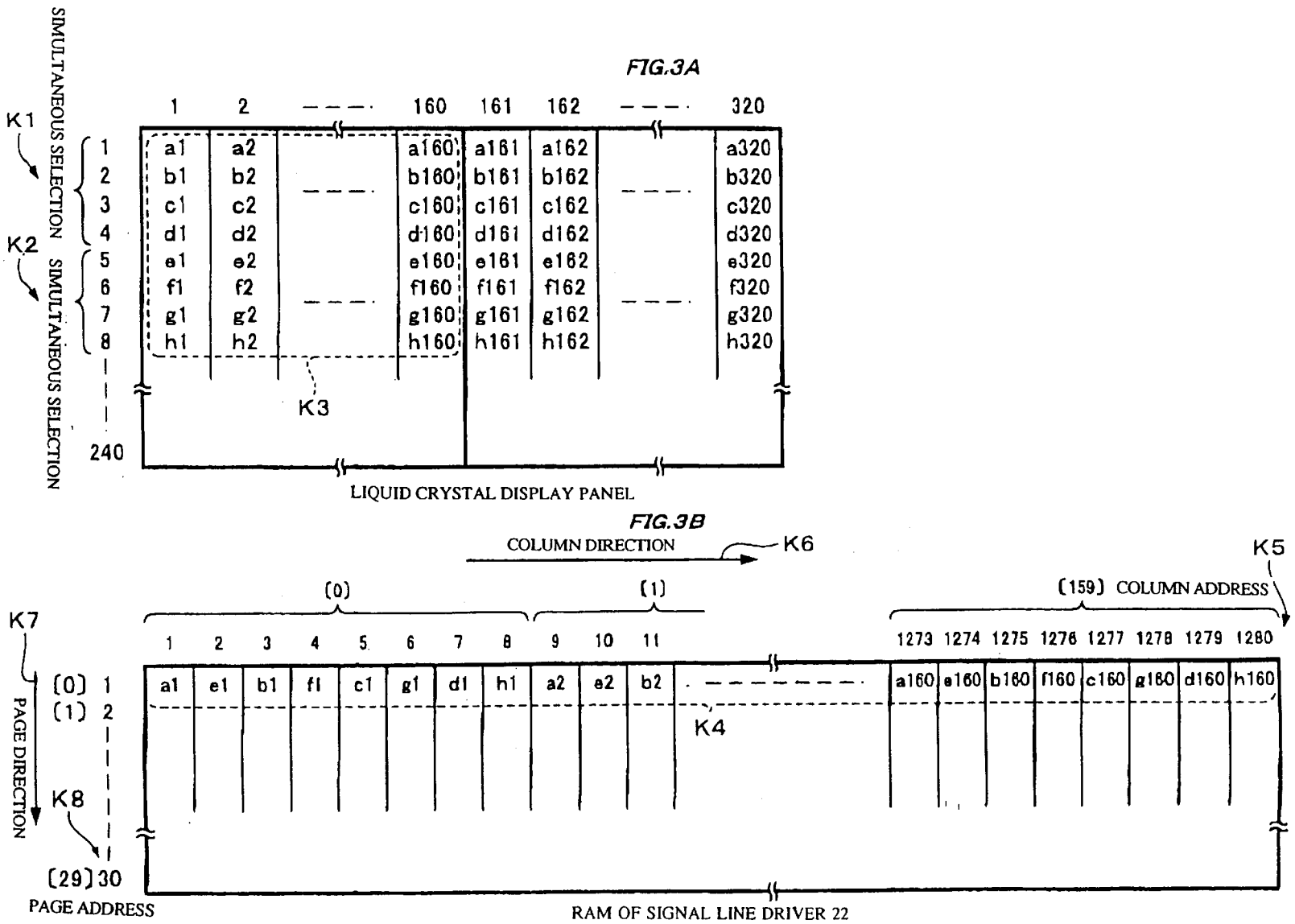
FIG. 3A is an illustration of a display address space of a liquid crystal display panel.
FIG. 3B is an illustration of a memory address space of a RAM of a first signal line driver.
Figure 4:
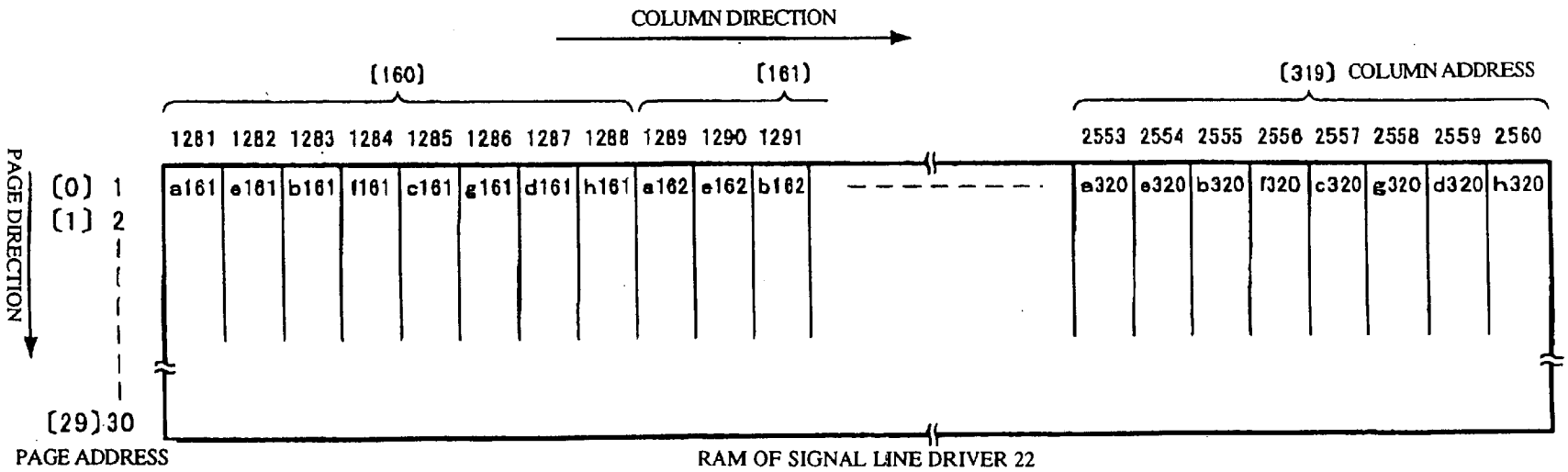
FIG. 4 is an illustration of a memory address space of a RAM of a second signal line driver.

FIG. 3A is an illustration of an example of a display address space of a liquid crystal display panel according to this embodiment, which has 320×240 pixels, and FIG. 3B is an illustration of an example of a memory address space of a RAM the signal line driver 22 contains and, further FIG. 4 is an illustration of an example of a memory address space of a RAM the signal line driver 24 incorporates.

In the case of the simultaneous four-line selection MLS drive, as indicated at K1 and K2 in FIG. 3A, the scanning lines 1 to 4 are selected simultaneously in a first selection period, while the scanning lines 5 to 8 are selected concurrently in the next selection period. Furthermore, in this embodiment, the display data (a1 to d160) to be used in the first and second selection periods, indicated by K3 in FIG. 3A, are written in one line of the RAM of the signal line driver 22, as indicated by K4 in FIG. 3B. In this way, only by setting one word line of the RAM to a selected condition, the display data to be used in the first and second selection periods can be read out together to be used in voltage determination processing for the MLS drive.

Thus, the number of memory cells corresponding to one line in the RAM of the signal line driver 22 comes to 160×8=1280 (the number of pixels indicated by K3 in FIG. 3A). Additionally, in this embodiment, the display data is written in the RAM in units of 8 bits (1 byte). This is because the transfer processing of the display data from the MPU is made in units of 8 bits so that, for accomplishing the pipeline processing properly, it is preferable to similarly write the display data in the RAM in units of 8 bits.

Accordingly, the address varies in units of 8 bits in a column direction indicated by K6 in FIG. 3B, and the number of addresses in the column direction is 1280 (number)÷8 (bit)=160, with the result that the column addresses in the RAM of the signal line driver 22 are [0, 1, 2 . . . 159].

On the other hand, in this embodiment, as shown in FIG. 3A, the number of scanning lines in the liquid crystal display panel is 240, and the display data corresponding to 8 scanning lines is written in the RAM. In consequence, in a page direction indicated by K7 in FIG. 3B, the number of memory cells, as indicated by K8, becomes 240÷8=30 through compression to 1/8. In consequence, the number of addresses in the column direction is 30 and the column addresses in the RAM the signal line driver 22 incorporates are [0, 1, 2 . . . 29].

Likewise, as shown in FIG. 4, the column address in the RAM contained in the signal line driver 24 becomes [160, 161, 162 . . . 319], and the page addresses become [0, 1, 2. . . 29].

Incidentally, in a case in which four signal line drivers are connected in cascade fashion, the column addresses in the RAM of the third signal line driver are [320, 321, 322 . . . 479], while the column addresses in the RAM of the fourth signal line driver are [480, 481, 482 . . . 639].

4. Configuration of RAM and Peripheral Circuits thereof

Figure 5:
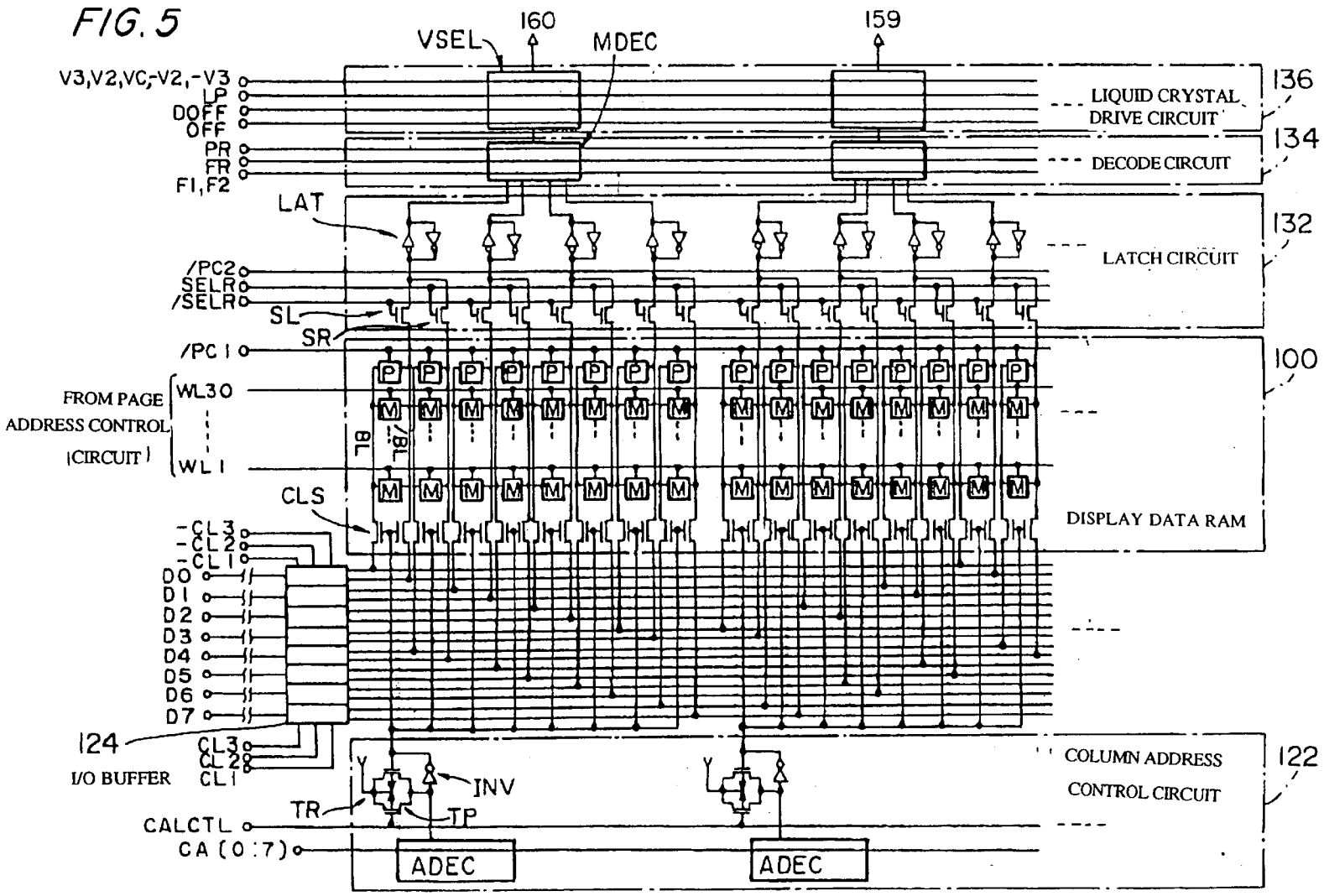
FIG. 5 is a circuit diagram showing a RAM and its peripheral circuits.

FIG. 5 shows concrete examples of configurations of the display data RAM 100 and its peripheral circuits (the column address control circuit 122, the I/O buffer 124, the latch circuit 132, the decode circuit 134, and the liquid crystal drive circuit 136).

The RAM 100 includes 30 word lines WL1 to WL30, 1280 (column) bit line pairs (BL, /BL), memory cells M connected to these lines for storing display data, and precharge circuits P for precharging the bit line pairs.

In addition, 16 bus lines constituting the outputs of the I/O buffer 124 are connected through column switches CLS to the 1280 bit line pairs (BL, /BL).

The column address control circuit 122 includes 160 column address decoders ADEC and decodes an 8-bit address CA [0:7], converted into a relative address in the column address converting circuit shown in FIG. 2. When the output of the column address decoder ADEC becomes an L level, while a control signal CALCTL is at an H level, the 8 column switches CLS connected to an inverter INV turn on simultaneously.

The latch circuit 132 includes switches SR and SL, turning on/off in accordance with latch signals (SELR, /SELR) and latches LAT for latching the outputs of the switches SR and SL.

For example, if the first word line WL1 is activated by the page address control circuit 140 in FIG. 2 and the latch signal SELR is made active, the display data on the scanning lines 1 to 4 (see K1) on the display address space in FIG. 3A are latched simultaneously in the latches LAT. Similarly, when the WL1 is made active and the latch signal /SELR is made active, the display data on the scanning lines 5 to 8 on the display address space in FIG. 3A are latched simultaneously in the latches LAT. Thus, when the page address control circuit 140 shown in FIG. 2 activates the word lines successively, the display data to be stored in the memory cells M are latched sequentially.

The decode circuit 130 includes 160 multi-line decoders MDEC. Each of the multi-line decoders DEC decodes the output of the latch LAT into a signal for the simultaneous four-line selection MLS drive on the basis of a PR (a signal for precharging the decoder), an FR (a liquid crystal alternating-current signal) and F1, F2 (field identification signals).

The liquid crystal drive circuit 136 includes 160 voltage selectors VSEL. Each of the voltage selector VSEL determines a signal voltage, to be applied to a signal line, on the basis of the output of the multi-line decoder MDEC and various kinds of voltages.

5. Arbitration Circuit and Peripheral Circuits thereof

Figure 6:
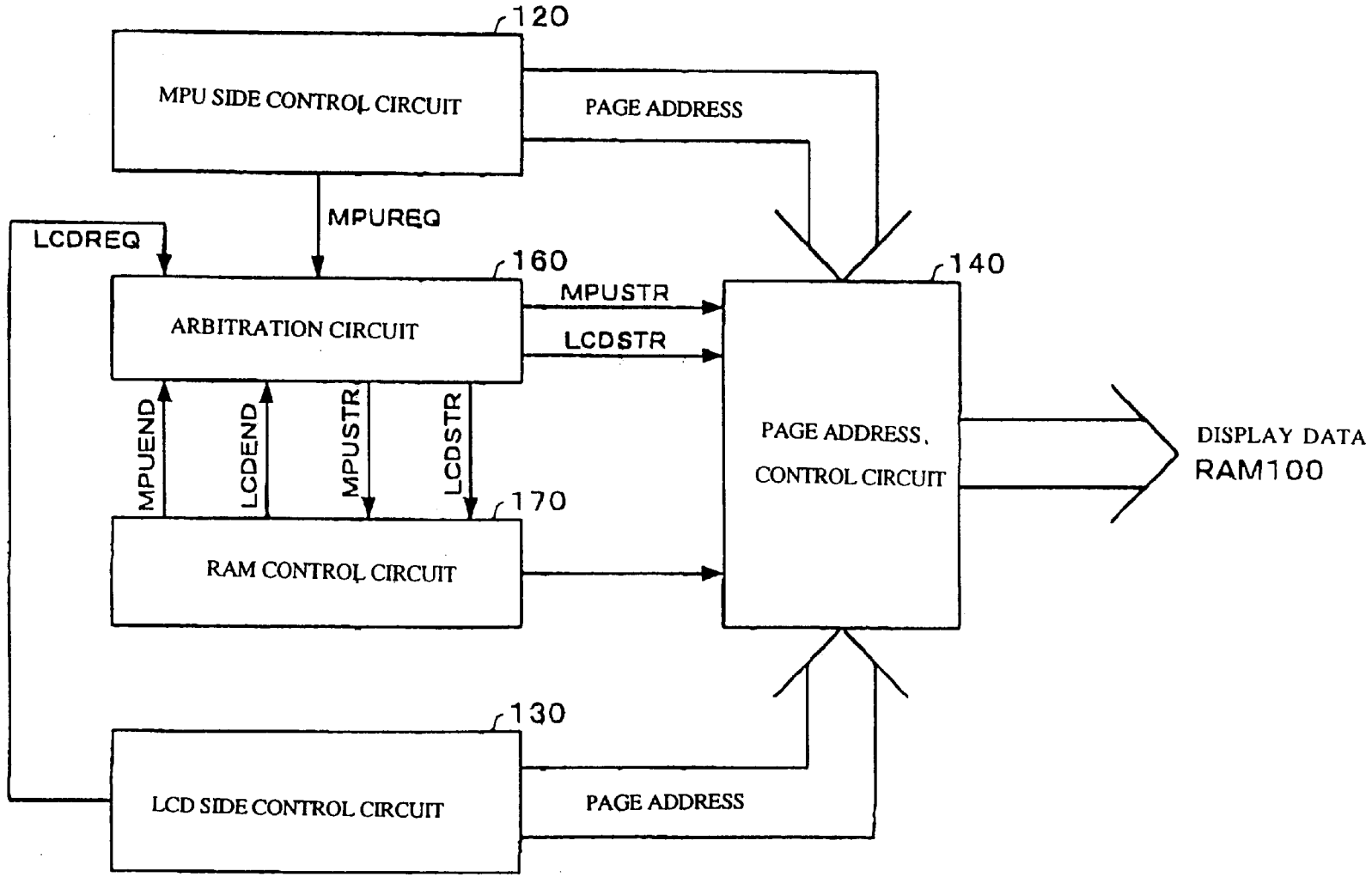
FIG. 6 is an illustration of the connective relationship between an arbitration circuit and its peripheral circuits.

FIG. 6 shows the connective relationship between the arbitration circuit 160 and its peripheral circuits.

In this embodiment, the arbitration circuit 160 is provided, since the access to the RAM 100 is gained in a time-division way in response to access requests from the MPU side and from the LED side.

As FIG. 6 shows, to the arbitration circuit 160, there are inputted an MPU access request signal MPUREQ (first access request signal) from the MPU side control circuit 120, an LCD access request signal LCDREG (second access request signal) from the LCD side control circuit 130, and an MPU access end signal MPUEND (first operation end signal) and an LCD access end signal (second operation end signal) from the RAM control circuit 170. On the basis of these input signals, the arbitration circuit 160 outputs an MPU access start signal MPUSTR (first operation start signal) and an LCD access start signal LCDSTR (second operation start signal) to the page address control circuit 140 and the RAM control circuit 170 in a time-division manner.

The page address control circuit 140 receives the start signals MPUSTR and LCDSTR from the arbitration circuit 160. Additionally, the page address control circuit 140 selects a page address from the MPU side control circuit 120 when the MPUSTR becomes active, while selecting a page address from the LCD side control circuit 130 when the LCDSTR becomes active.

The RAM control circuit 170, upon receipt of the start signals MPUSTR and LCDSTR from the arbitration circuit 160, determines a start timing (generates a pulse signal) for making a word line active. Furthermore, the page address control signal 140 activates the word line corresponding to the selected page address at the determined start timing (pulse signal).

The RAM control circuit 170 has an additional function to generate the end signals MPUEND and LCDEND. The end signal MNPUEND becomes active at the elapse of a predetermined period of time after the activation of the start signal MPUSTR. Likewise, the end signal LCDEND becomes active at the elapse of a predetermined period of time after the activation of the start signal LCDSTR. That is, the RAM circuit 170 makes the end signals MPUEND and LCDEND active by utilizing a delay time to be taken when the inputted start signals MPUSTR and LCDSTR are converted into the actual memory access signals and transmitted to the RAM 100.

6. Detailed Example of Arbitration Circuit

Figure 7:
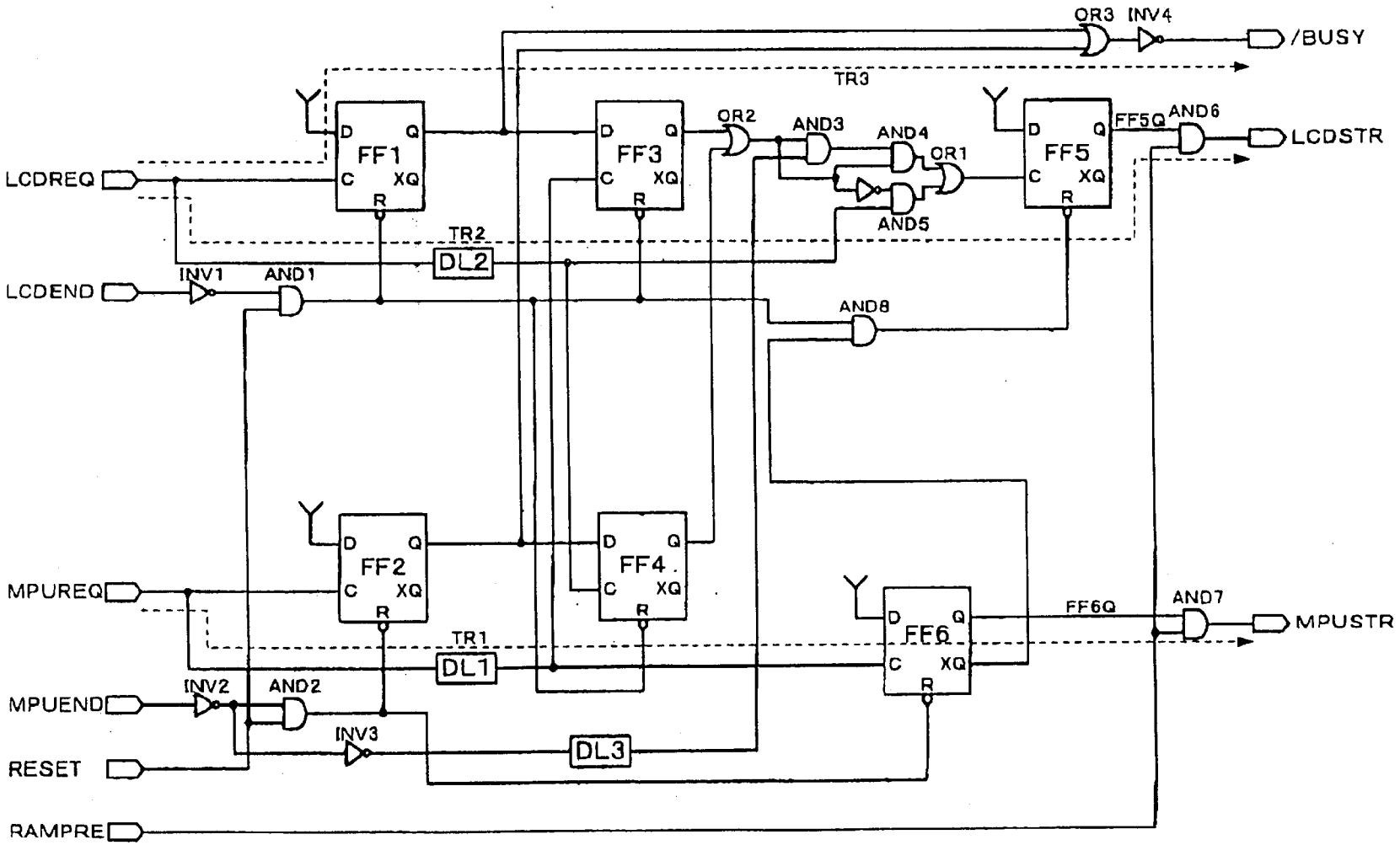
FIG. 7 is a circuit diagram showing an arbitration circuit.

FIG. 7 shows a detailed example of a configuration of the arbitration circuit 160. The description of the configuration and operation of the arbitration circuit in FIG. 7 will be given in a state divided according to the cases as follows. Additionally, the description will first be made assuming that a precharge signal (RAMPRE) is at an H level in the illustration. Still additionally, flip-flops FF1 to FF6 in FIG. 7 are all reset with a reset signal RESET becoming at an L level at the initial setting.

(C1) Case in Which Only MPU Access-Request Takes Place

In this case, only a request signal MPUREQ turns to an H level, while a request signal LCDREQ, an end signal MPUEND and an LCDEND are all at an L level.

The request signal MPUREQ is put through a delay circuit DL1 into the C input of the flip-flop FF6. Therefore, when the MPUREQ becomes an H level, the Q output of the FF6 in which the D input is set at an H level turns to an H level, and the start signal MPUSTR becomes active (H level).

As described above, a first through path TR1 is established, depending on the MPUREQ, and the start signal MPUSTR becomes active, which starts an access operation to the RAM 100 according to a command from the MPU 60. As a result, display data is read from or written in the RAM 100 in units of one byte. Following this, when the RAM control circuit 170 sets the end signal MPUEND to the H level, the access operation to the RAM 100 comes to completion.

(C2) Case in Which Only LCD Access Request Takes Place

In this case, only the request signal LCDREQ is at an H level. Furthermore, this LCDREQ is put through a delay circuit DL2 into one input of an AND gate AND5.

Additionally, an output of an OR gate OR2 is put into the other input of the AND gate AND5 in a state inverted, while the Q outputs of flip-flops FF4 and FF3 are given to the inputs of the OR2. Still additionally, since the Q output of a flip-flop FF2, which is at an L level, is given to the D input of the flip-flop FF4, the Q output of the FF4 is left in a state of an L level. Moreover, since a clock is not inputted to the flip-flop FF3, its Q output remains at an L level. Accordingly, the output of the OR gate OR2 becomes an L level. Still moreover, since the one input of the AND gate AND5 is at an H level, the output of the AND5 becomes an H level. Therefore, the output of an OR gate OR1 becomes an H level, while the Q output of a flip-flop FF5 becomes an H level. Hence, the start signal LCDSTR becomes active (H level).

As described above, a second through path TR2 is set up depending on the LCDREQ and the start signal LCDSTR becomes active, thereby implementing a reading operation of display data corresponding to four scanning lines from the RAM 100. Thereafter, the reading operation from the RAM 100 comes to an end when the RAM control circuit 170 sets the end signal LCDEND to an H level.

(C3) Case in Which LCD Access Request Takes Place After MPU Access Request

Figure 8:
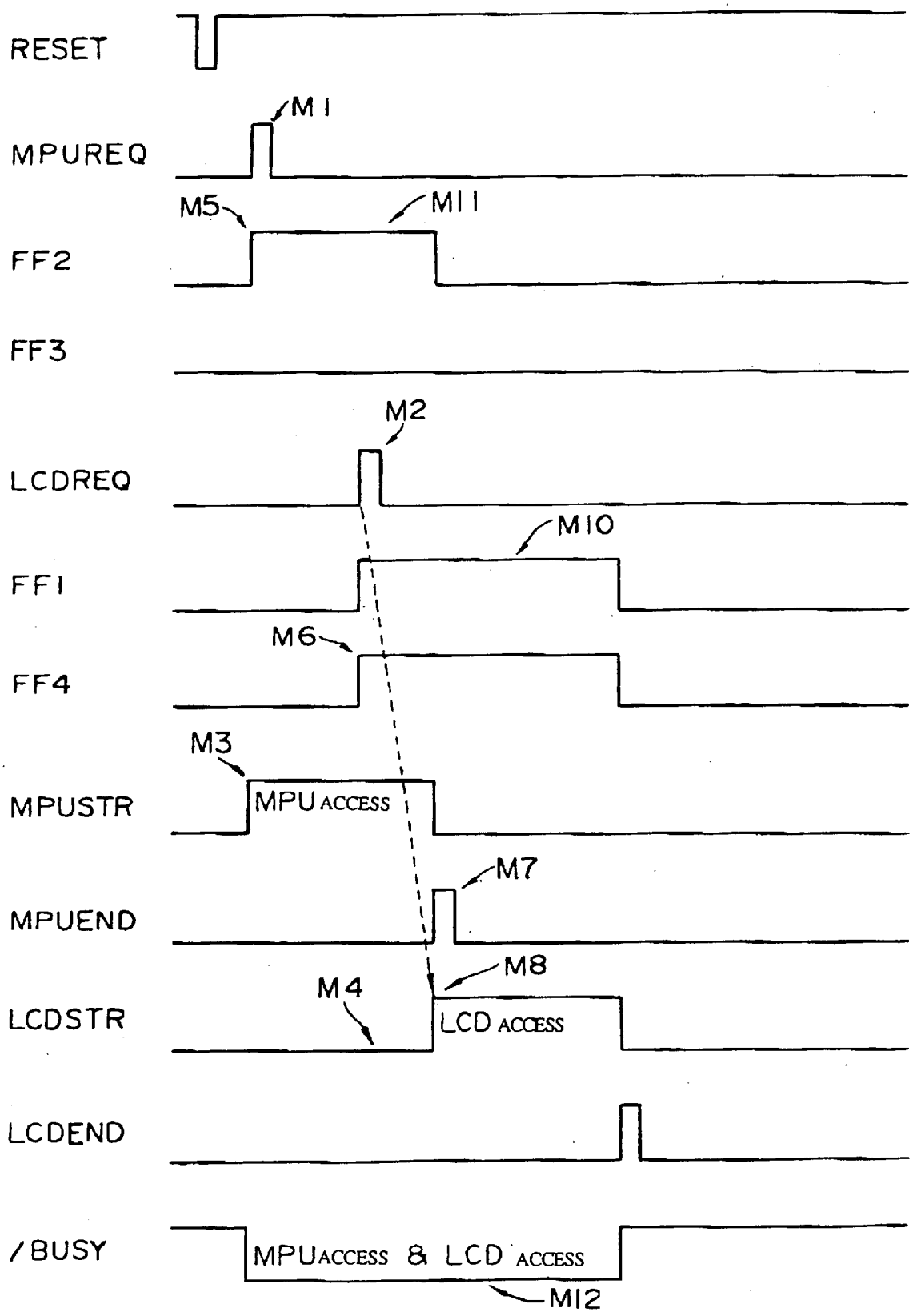
FIG. 8 is a timing chart for describing an operation of an arbitration circuit to be conducted for when an LCD access request takes place after an MPU access request.

This is a case in which the request signal LCDREQ becomes an H level after the request signal MPUREQ becomes an H level as indicated by M1 and M2 in FIG. 8.

First, when the request signal MPUREQ turns to an H level as indicated by M1, as described above in (C1), the first through path TR1 is set up, depending on the MPUREQ (see FIG. 7), and the start signal MPUSTR becomes active, as indicated by M3.

Following this, even if the request signal LCDREQ becomes an H level, as indicated by M2, the start signal LCDSTR remains at an L level, as indicated by M4, and for the following reason.

That is, when the request signal MPUREQ becomes the H level, the Q output of the flip-flop FF2 becomes an H level, as indicated by M5. In this state, if the request signal LCDREQ becomes the H level as indicated by M2, the Q output of the FF4 whose D input is connected to the Q output of the FF2 also turns to an H level indicated by M6. Accordingly, the output of the OR gate OR2 to which the Q output of the FF4 is inputted also turns to an H level, and the output of the AND5 to which an inverted signal of the output of the OR2 is inputted is set compulsively at an L level, irrespective of whether the LCDREQ is at the H level or at the L level; in consequence, in the case of (C2) described above, the establishment of the second through path TR2 is canceled.

Furthermore, at the time that the request signal LCDREQ turns to the H level, the end signal MPUEND is at the L level. Accordingly, the output of an AND gate AND3 becomes an L level and the output of an AND gate AND4 also becomes an L level. Therefore, the output of the OR gate remains at an L level, which does not permit the establishment of a third path TR3.

As described above, since both the paths TR2 and TR3 are not set up at the time that the request signal LCDREQ turns to the H level, the start signal LCDSTR remains at the L level, as indicated by M4 in FIG. 8.

Thereafter, when the MPU access operation (access operation according to an MPU access request) reaches completion and the end signal MPUEND turns to the H level, as indicated by M7, the start signal LCDSTR becomes the H level, as indicated by M8, and an LCD access operation (access operation according to an LCD access request) starts. Thus, the access to the RAM is gained in a time-division manner on the MPU side and on the LCD side.

(C4) Case in Which MPU Access Request Takes Place after LCD Access Request

Figure 9:
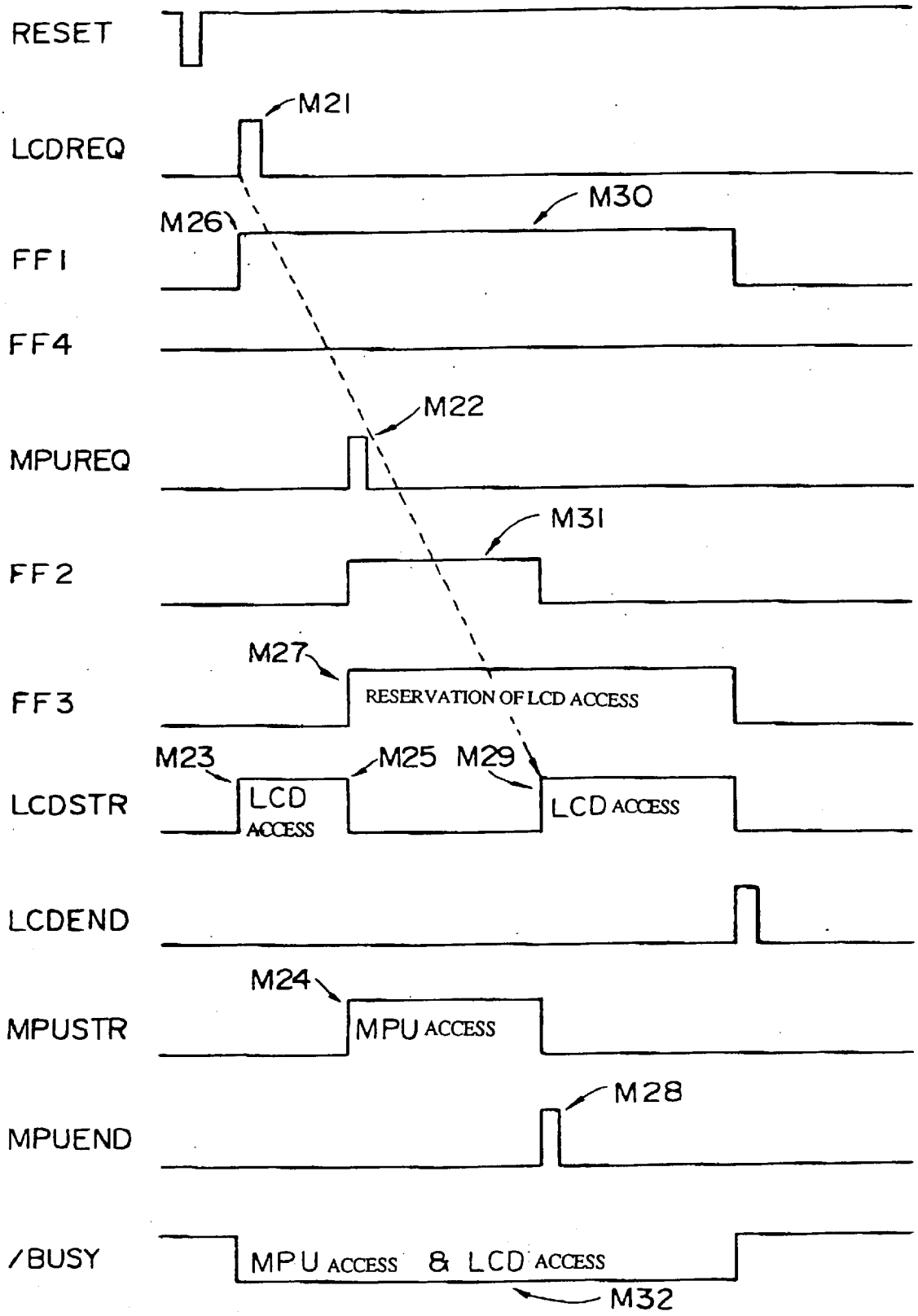
FIG. 9 is a timing chart for describing an operation of an arbitration circuit to be conducted for when an MPU access request takes place after an LCD access request.

This is a case in which the request signal MPUREQ turns to the H level after the request signal LCDREQ becomes the H level, as indicated by M21 and M22 in FIG. 9.

First, when the request signal MPUREQ turns to the H level, as denoted at M21, the second through path TR2 (see FIG. 7) is set up due to the LCDREQ, as described above in (C2) so that the start signal LCDSTR becomes active, as denoted by M23.

Following this, when the request signal MPUREQ becomes the H level, as denoted at M22, the first through path TR1 is established, as shown in FIG. 7, and the start signal MPUSTR becomes active, as denoted at M24. At this time, the flip-flop FF5 is reset because the XQ output of the FF6 becomes an L level. Accordingly, the start signal LCDSTR is reset compulsively to the L level, as denoted at M25, without waiting for the end signal LCDEND turning to the H level, thereby ceasing (interrupting) the LCD access operation.

Now, at the time that the request signal LCDREQ becomes the H level, the Q output of the flip-flop FF1 becomes the H level, as denoted at M26. In this state, if the request signal MPUREQ turns to the H level, as denoted at M22, the Q output of the FF3 whose D input is connected to the Q output of the FF1 also becomes the H level, as denoted at M27. That is, reservation information (H level) about the resumption of the LCD access operation, ceased once, is held in the flip-flop FF3 (holding circuit).

In this state, when the end signal MPUEND turns to the H level, as denoted at M28, the output of the OR gate OR2 to which the Q output (H level) of the FF3 is inputted is at an H level. Hence, the outputs of the AND gates AND3, AND4 and the OR gate OR1 become an H level. This establishes the third path TR3. In consequence, the output of the flip-flop FF5 becomes the H level, and the start signal LCDSTR again becomes active as denoted at M29. Additionally, the LCD access operation, stopped at M25, is resumed. That is, the LCD access operation is resumed on the basis of the reservation information held in the flip-flop FF3.

As stated above, in the case in which the MPU access request is made after the LCD access request, the LCD access operation, which was started by the LCD access request, is stopped (interrupted), whereas the MPU access operation begins. Furthermore, after the completion of the MPU access operation, the LCD access operation is resumed.

(C5) Case in Which MPU Access Request and LCD Access Request Take Place Simultaneously This case signifies that the request signal MPUREQ becomes the H level, so that the first through path TR1 is set up and the start signal MPUSTR becomes active.

On the other hand, because both the outputs of the flip-flops FF3 and FF4 become the H level, the output of the OR gate OR2 becomes the H level, so that the output of the AND gate AND5 is set compulsively at the L level, which inhibits the formation of the second through path TR2. Additionally, when the end signal MPUEND is at the L level, the output of the AND gate AND3 also becomes the L level, which inhibits the organization of the third path. Thus, because of no establishment of both the paths TR2 and TR3, the start signal LCDSTR does not become active.

Meanwhile, if the end signal MPUEND becomes the H level, the third path TR3 is set up and the start signal LCDSTR becomes active, so that the LCD access operation starts.

As stated above, in this embodiment, in the case in which a competition occurs between an MPU access request (first access request) and an LCD access request (second access request), the priority is always given to the MPU access request. That is, as FIG. 9 shows, when the MPUREQ becomes the H level after the LCDREQ becomes the H level, the LCD access operation comes to interruption while the MPU access operation starts instead. This LCD access operation resumes after the completion of the MPU access operation.

Conversely, according to the conventional technique disclosed in Japanese Unexamined Patent Publication No. 10-105505, when a competition comes about between an MPU access request and an LCD access request, the access request inputted first has preference. That is, as shown in FIG. 7 of Japanese Unexamined Patent Publication No. 10-105505, when an MPUREQ turns to an H level after an LCDREQ becomes an H level, an LCD access operation starts first, and an MPU access operation starts after the completion of an LCD access operation.

However, in the case of this conventional technique, there is a need to conduct the processing to determine the priority to one of the MPU access request and the LCD access request on the basis of the difference in lime between the generation of the MPU access request and the generation of the LCD access request. For this reason, as shown in FIG. 5 of Japanese Unexamined Patent Publication No. 10-105505, the configuration of an arbitration circuit becomes complicated, so that malfunction tends to occur.

This embodiment, by contrast, always gives the priority to the MPU access request when a competition arises between the MPU access request and the LCD access request. Therefore, as shown in FIG. 7, the arrangement of the arbitration circuit becomes simple and the occurrence of malfunction is effectively preventable.

In addition, in the-case of an application by which an MPU waits according to the poling method until the MPU access operation comes to completion, according to the conventional technique disclosed in Japanese Unexamined Patent Publication No. .10-105505, the MPU cannot implement another task until the LCD access operation comes to an end.

However, according to this embodiment, since the MPU access request has preference at all times, so that the MPU access operation is conducted immediately, there is no need for the MPU to wait. In consequence, the task processing of the MPU is achievable with higher efficiency.

7. Time-Division Access to RAM

Figure 10:
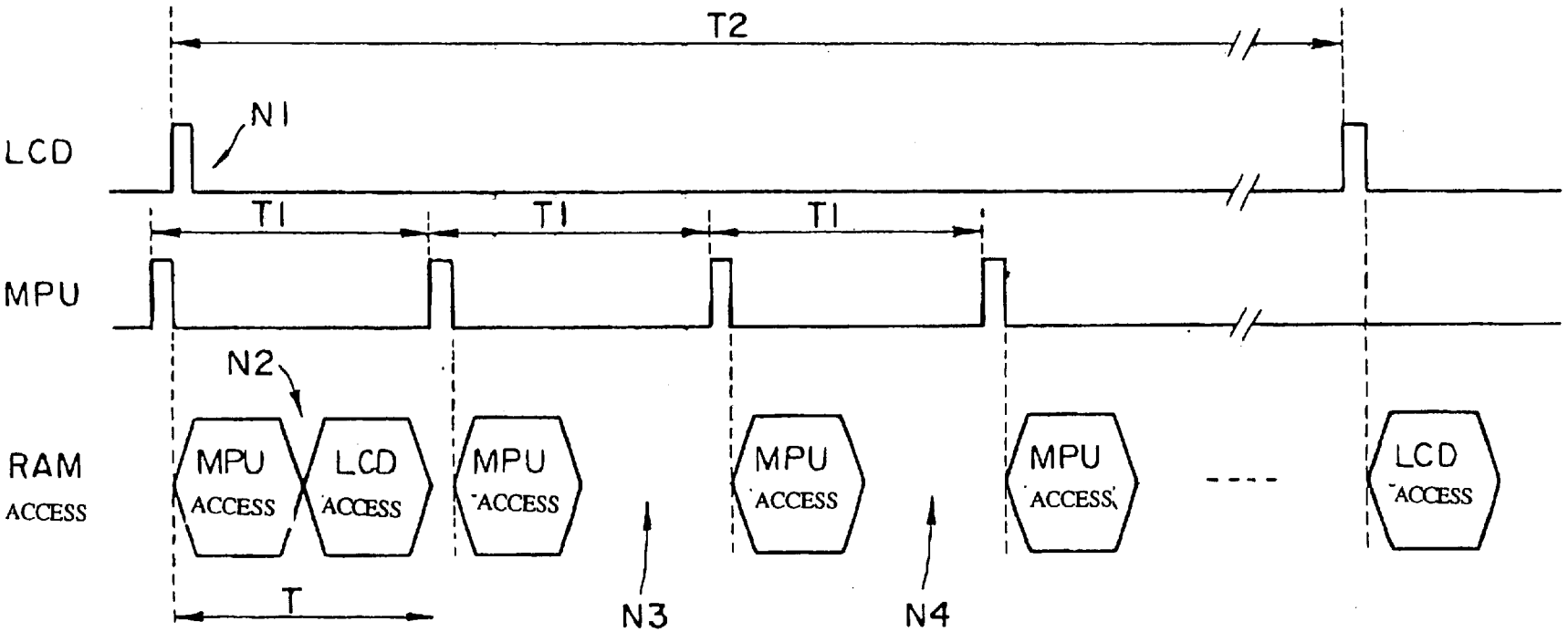
FIG. 10 is an illustration for describing a processing time for an access operation in a case in which an LCD access request takes place after an MPU access request.

FIG. 10 is an illustration of a state of a time-division access to a RAM, in the case in which an LCD access request takes place after an MPU access request, as shown in FIG. 8. In FIG. 10, a time T1 between MPU access requests is determined in the specification to be above a time T, which is the sum of a processing time of an MPU access operation, and a processing time of an LCD access operation. If T1≧T, even when a competition occurs between the MPU access request and the LCD access request, as denoted by N1 in FIG. 10, an appropriate time-division access becomes feasible, as denoted by N2. In other words, each of the processing times for the MPU access operation and for the LCD access operation is required to be below a time T½.

Figure 11:
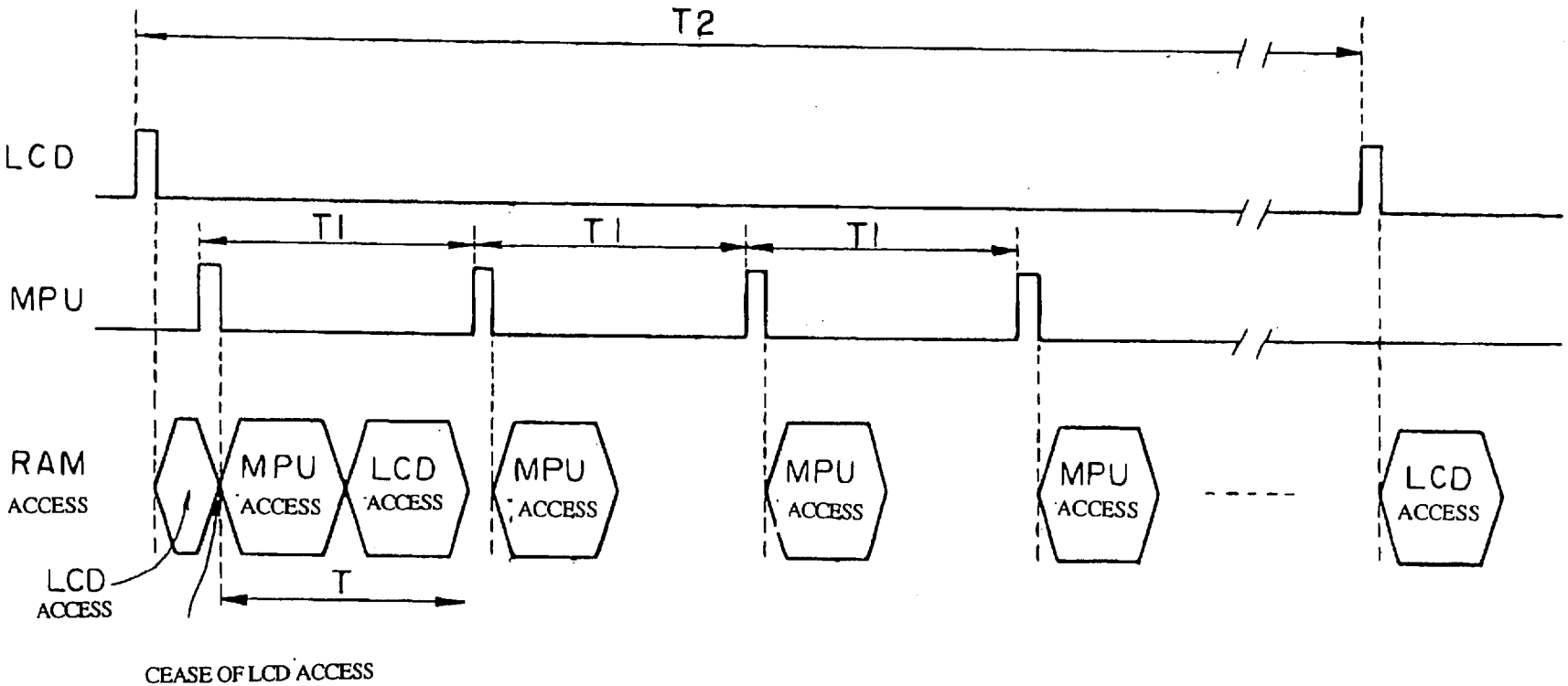
FIG. 11 is an illustration for describing a processing time for an access operation in a case in which an MPU access request takes place after an LCD access request.

FIG. 11 is an illustration of a state of a time-division access to the RAM, in the case in which the MPU access request takes place after the LCD access request, as shown in FIG. 9. Also, in this case, the time T1 between the MPU access requests is set to be above the time T, forming the processing time of the MPU access operation plus the processing time of the LCD access operation.

8. Memory Access Monitor Signal

In this embodiment, as FIG. 2 shows, a memory access monitor signal /BUSY for monitoring an access state to a RAM is outputted through an MPU interface 110 to an external terminal.

This monitor signal /BUSY can be produced by inverting the output of an OR gate OR3, which receives the Q outputs of the flip-flops FF1 and FF2 as inputs thereto, through the use of an inverter INV4, as shown in FIG. 7.

In this case, as denoted at M10 in FIG. 8 and at M30 in FIG. 9, the Q output of the flip-flop FF1 turns to an H level when a request signal LCDREQ becomes an H level (active), while turning to an L level (inactive) when an end signal LCDEND becomes an H level (active).

On the other hand, as denoted at M11 in FIG. 8 and at M31 in FIG. 9, the Q output of the flip-flop FF2 turns to an H level when the request signal MPUREQ becomes the H level, while turning to an L level when the end signal MPUEND becomes the H level. The memory access monitor signal /BUSY is attainable from the logical sum (OR, NOR, and others) of the Q outputs of these flip-flops FF1 and FF2.

Thus, as denoted at M12 in FIG. 8 and at M32 in FIG. 9, the monitor signal /BUSY becomes an L level (active) when either the MPU access operation or the LCD access operation takes place. In consequence, the signal /BUSY can be used as a monitor signal for monitoring whether or not the access to an incorporated RAM of a signal line driver takes place.

This monitor signal /BUSY outputted to the external terminal can be utilized as reference information to be referred to in determining a specification for the time T1 (see FIGS. 10 and 11) between the MPU access requests.

That is, since an access to the RAM is made properly in a time-division manner even if a completion occurs between the MPU access request and the LCD access request as shown in FIG. 10, the time T1 between the MPU access requests is required to exceed the time T, made by the processing time for the MPU access operation plus the processing time for the LCD access operation.

Meanwhile, the foregoing time T varies with operating voltages of the signal line driver, temperatures at the operation thereof, differences between manufacturing processes thereof and the like. For this reason, in determining a specification for the time (cycle time) T1 between the MPU access requests, a need exists to afford a large margin, which results in a prolongation of the time T1. What's worse, the prolongation of the time T1 signifies that the writing time of display data from the MPU becomes longer and, particularly in the case in which the liquid crystal display panel has a larger screen, this creates a serious problem.

On the other hand, according to this embodiment, the specification of the time T1 can be determined easily in a manner that the monitor signal /BUSY is outputted to the external terminal, and the signal level of the /BUSY or the variation of the signal level is measured at the evaluation of the signal line driver.

That is, as shown at M12 of FIG. 8 and at M32 of FIG. 9, when a competition occurs between an MPU access request and an LCD access request, the monitor signal. /BUSY becomes active (L level) for the time T equal to the sum of the processing time of the MPU access operation and the processing time of the LCD access operation (it is also possible that it is active for a time longer than the time T). Accordingly, if the time that the monitor signal /BUSY is active is measured at the competition between the access requests, so that the time T1 is determined to exceed this measured time, a proper time-division access to the RAM becomes possible.

Incidentally, as a method differing from this embodiment, it is also considered that monitor information (monitor bit), indicative of whether or not the RAM is in the process of access is stored in an internal register of the signal line driver. According to this method, the MPU can read out the monitor information from the internal register of the signal line driver to make a decision as to whether or not the RAM is in the process of access. However, this method cannot monitor the time of the access operation to the RAM (a time that the monitor signal /BUSY continues an L level), accordingly, difficulty is encountered in determining the time T1 between the MPU access requests.

9. High-Speed Operation Using Memory Access Monitor Signal

In FIGS. 10 and 11, the access frequency of the MPU access request is, for example, approximately 2 MHz, and the time T1 between the MPU access requests is, for example, approximately 500 ns. On the other hand, the latch frequency of the latch circuit 132 in FIG. 2 is, for example, approximately 14.4 kHz, and the time T2 between the LCD access requests is approximately 69.4 ms. Thus, the time T2 between the LCD access requests is sufficiently longer than the time T1 between MPU access requests. In addition, in FIG. 10, when the time forming the sum of the processing time of the MPU access operation and the processing time of the LCD access operation is taken as T, T is set to be T1≧T. In consequence, in a case in which display data are written continuously from the MPU into the RAM, at N3 and N4 in FIG. 10, the access operation to the RAM does not take place, which incurs useless processing. That is, difficulty is experienced in optimizing the time-division access to the RAM, which creates a serious problem, specifically in the case where the liquid crystal display panel has a larger screen.

Figure 12:
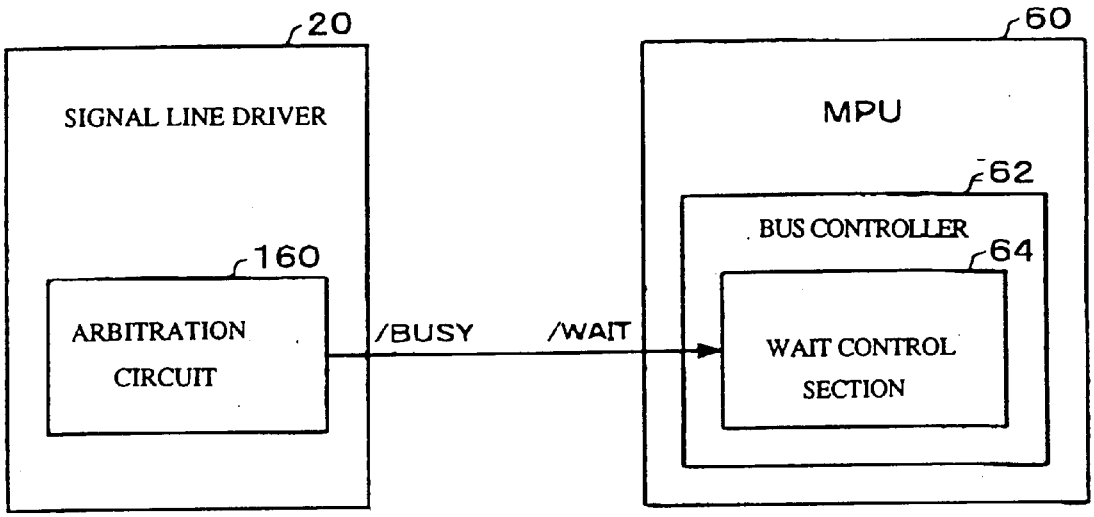
FIG. 12 is an illustration for describing a method of connecting a memory access monitor signal to a hardware wait terminal if an MPU.

Therefore, for eliminating this problem, as FIG. 12 shows, the memory access monitor signal /BUSY is connected to a wait terminal /WAIT (hardware wait) of the MPU 60. In this way, a wait control section 64 and a bus controller 62 of the MPU contains and implements the wait control in accordance with an access state of the signal line driver to the RAM. Hence, a high-speed operation is expected in continuously writing display data from the MPU 60 in the RAM.

Figure 13:
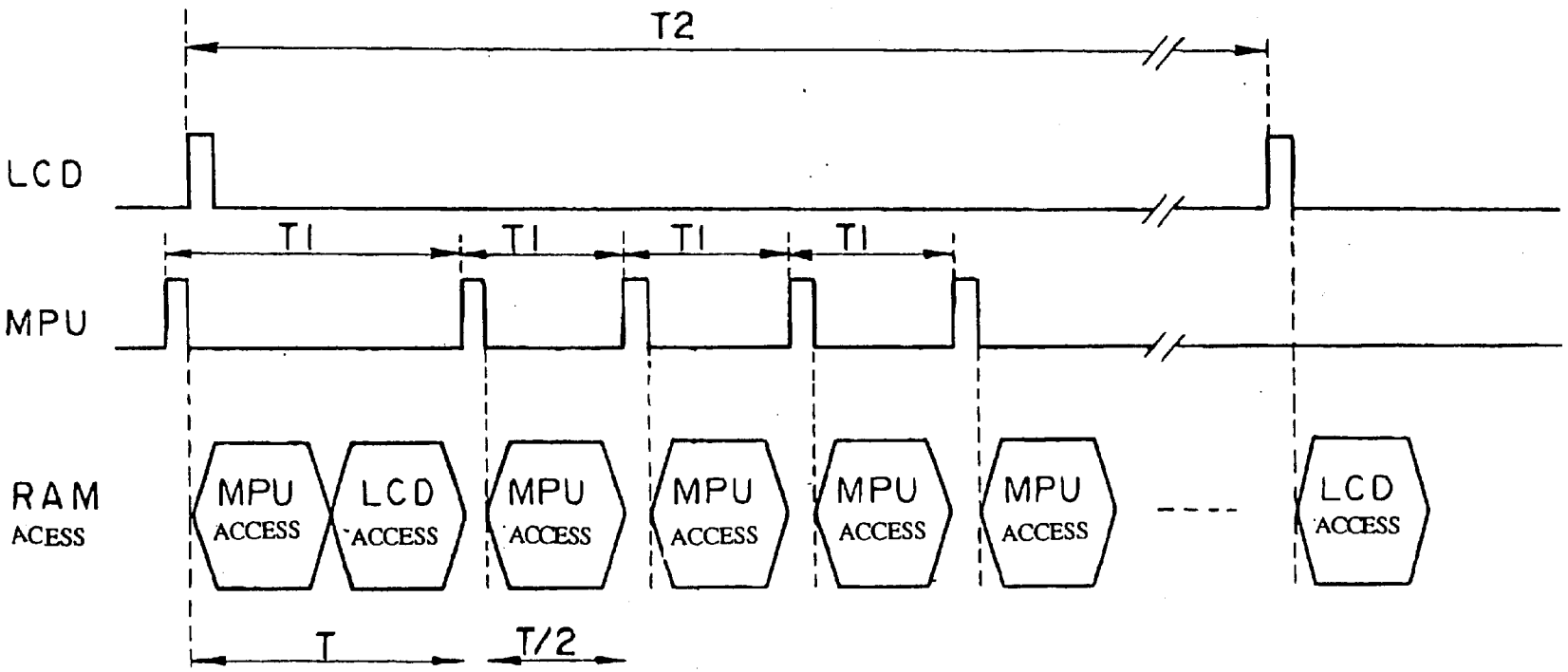
FIG. 13 is an illustration for describing a method of realizing a high-speed access operation of an MPU.

That is, as FIG. 13 shows, the time T1 between the MPU access requests can assume T1=T/2 (or T1≧T/2) with few exceptions, and only in the case of the occurrence of a competition between the MPU access request and the LCD access request, T1 is set as T1=T (or T1≧T). Hence, as compared with the case of T1=T (T1≧T) in FIG. 10, the continuous display data writing processing can reach completion more quickly.

10. High-Speed Using Precharge Monitor Signal

Figure 14:
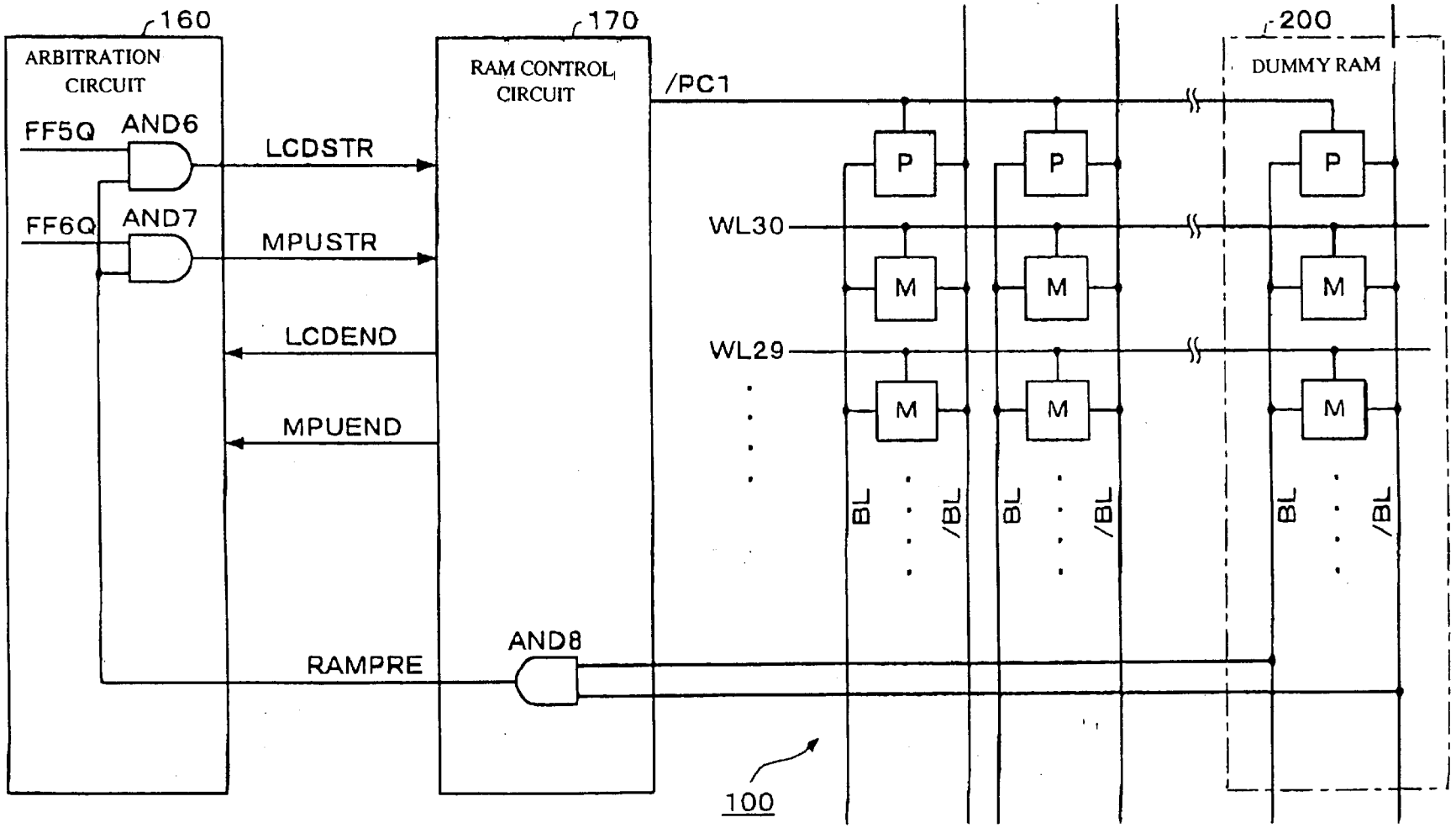
FIG. 14 is an illustration for describing a method of starting an access operation of an MPU on condition that a decision shows that a precharge operation of a RAM reaches completion.

In this embodiment, as FIG. 14 shows, the arbitration circuit 160 outputs RAM access start signals LCDSTR and MPUSTR to the RAM control circuit 170, while the RAM control circuit 170 outputs RAM access end signals LCDEND and MPUEND to the arbitration circuit 170. Additionally, the RAM control circuit 170 outputs a RAM 100 precharge state monitor signal RAMPRE to the arbitration circuit 170. This monitor signal RAMPRE is a signal which becomes an H level when a decision is made that the RAM 100 precharge operation reaches completion.

That is, originally at the access to the RAM, a series of operations are required which conduct the read/write from/in the memory cells after the precharge of bit line pairs (BL, /BL) to an H level. Hence, when the arbitration circuit 160 makes the start signal MPUSTR or LCDSTR active (H level), the RAM control circuit 170 is required to conduct the precharge operation for the RAM 100 initially. More concretely, the RAM control circuit 170 makes a precharge signal /PC1 active, while each of the precharge circuits P, receiving this signal /PC1, precharges each of the bit line pairs (BL, /BL) to an H level.

In this case, in a conventional design, the precharge term has been set to be sufficiently long to provide a large margin to cause an access operation to start after the completion of a precharge operation. In consequence, the RAM access time results in being long, which makes it difficult to realize the high-speed operation.

For this reason, in this embodiment, a dummy RAM 200 (decision means for deciding whether or not the precharge reaches completion) is provided, as shown in FIG. 14, and an AND gate AND8 accepting the bit line pair (BL, /BL) of the dummy RAM 200 as inputs is provided in the RAM control circuit 170. In this way, when the bit line pair (BL, /BL) of the dummy RAM 200 turn to an H level due to the precharge, a precharge monitor signal RAMPRE forming the output of the AND gate AND 8 (logical product in a wide sense; An NAND or the like is also acceptable) also becomes an H level, which allows the monitoring as to whether or not the precharge operation comes to an end.

Figure 15:
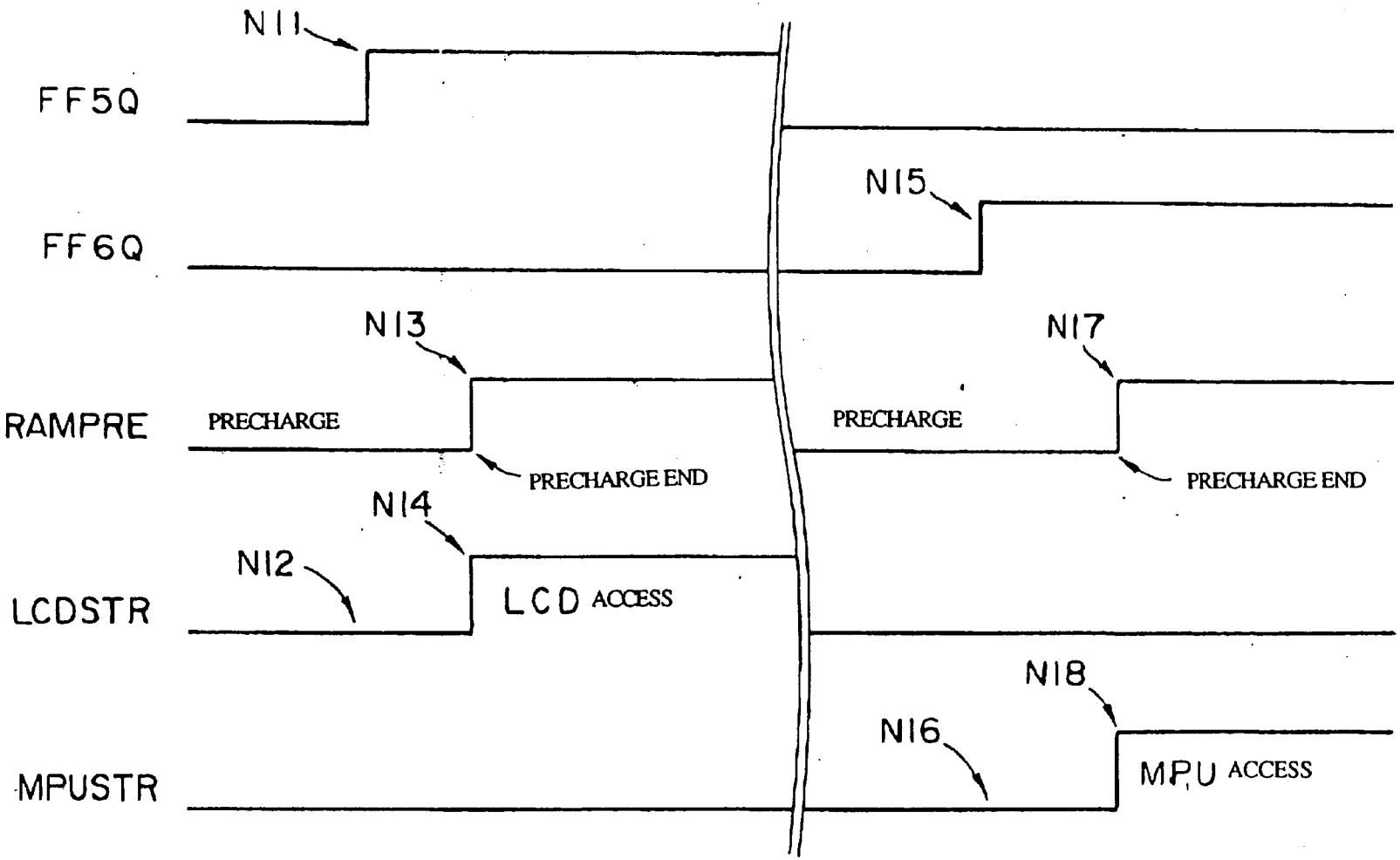
FIG. 15 is a timing chart for describing the method shown in FIG. 14.

That is, as shown at N11 of FIG. 15, even if an FF5Q, being the output of the flip-flop FF5, becomes an H level, when the monitor signal RAMPRE is at an L level, the start signal LCDSTR remains at an L level, as denoted at N12. Furthermore, only when the monitor signal RAMPRE turns to an H level, as denoted at N12, the start signal LCDSTR becomes an H level, as denoted at N14. Accordingly, the LCD access can start immediately after the precharge operation reaches completion.

Likewise, even if, as denoted at N15, an FF6Q, being the output of the flip-flop FF6, becomes an H level, when the RAMPRE is at the L level, the MPUSTR remains at the L level, as denoted at N16. Furthermore, the MPUSTR becomes the H level, as denoted at N18 only when the RAMPRE becomes the H level, as denoted at N17. Accordingly, the MPU access can start immediately after the precharge operation comes to an end.

As described above, in this embodiment, when the RAM precharge operation reaches completion and the precharge monitor signal RAMPRE becomes the H level, the RAM access operation becomes possible immediately. Therefore, it is possible to accomplish the optimization of the access time to the RAM for the speed-up of the RAM access.

11. Speed-up of Continuous Data Transfer

The above-described method achieves the speed-up if the RAM accesses by optimizing the RAM access time. Here, a description will be given of another method of realizing the speed-up of the continuous data transfer.

The display address space of the liquid crystal display panel and the memory address space of the RAM in this embodiment are as described above with reference to FIGS. 3A, 3B and 4. The MPU previously designates column addresses [0 to 319] and page addresses [0 to 29] for conducting the display data writing or reading processing.

Figure 16:
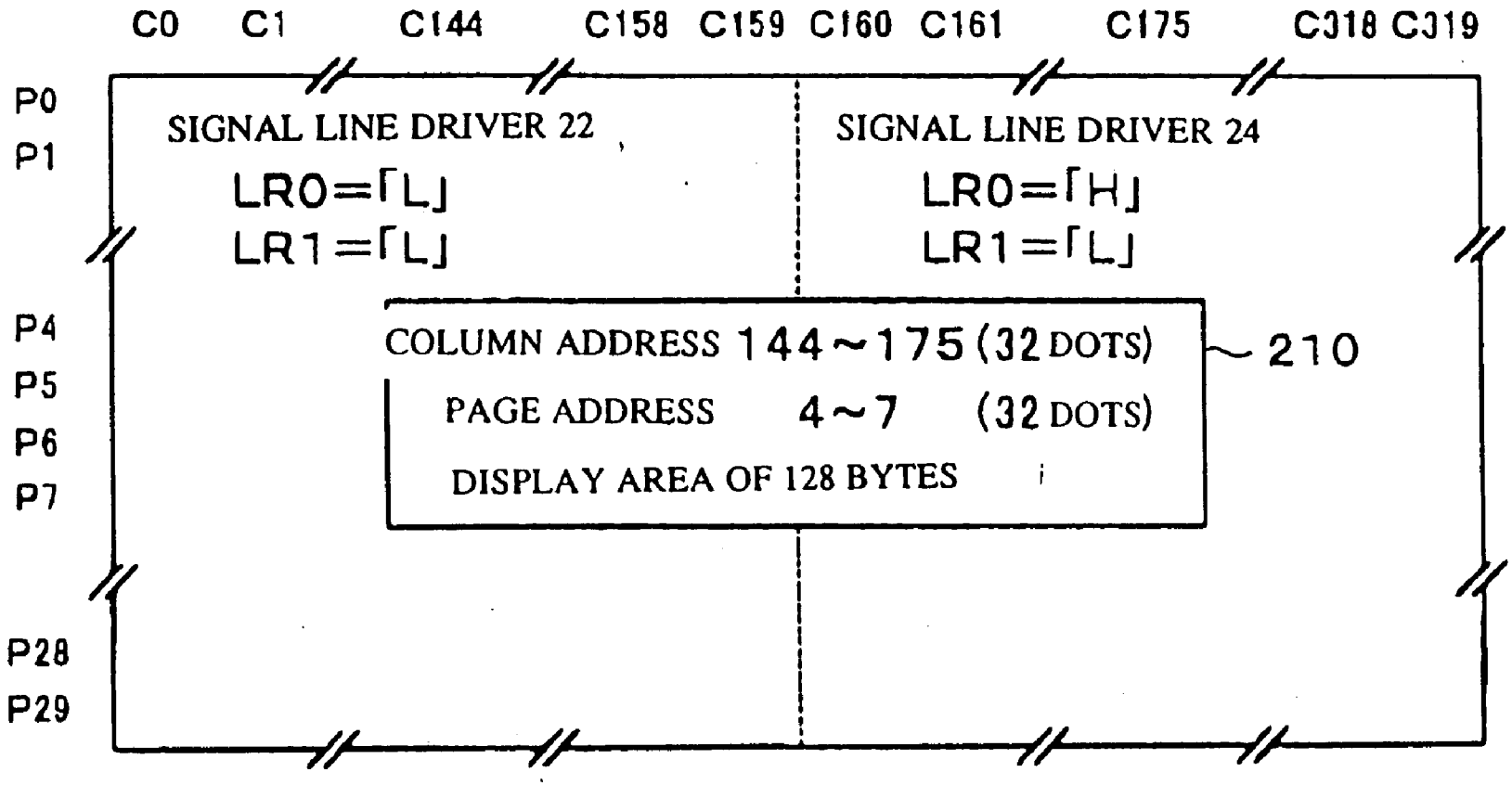
FIG. 16 is an illustration for describing a method of rewriting display data in a specified display area.

In this case, the description handles the case in which the MPU rewrites the display data, for example, in a specified display area (column addresses 144 to 175, page addresses 4 to 7) shown in FIG. 16.

As a technique for rewriting display data in such a specified display area, for example, there has been known a conventional means disclosed in Japanese Unexamined Patent Publication No. 10-106254.

Figure 17A:
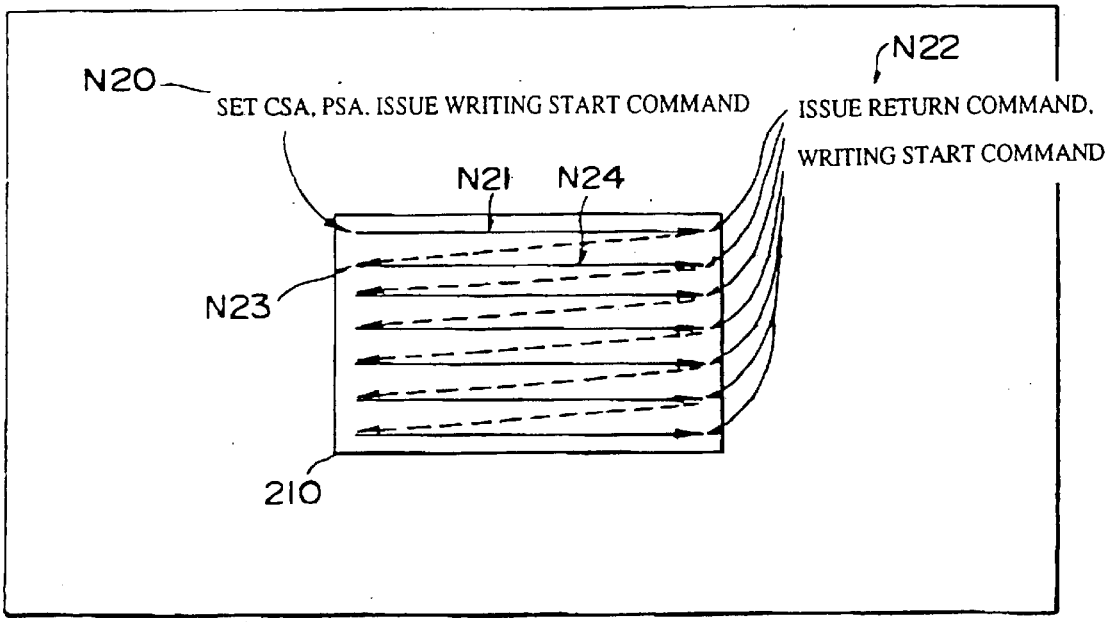
FIG. 17A is an illustration for describing a rewriting method according to a conventional technique.

In this conventional technique, as shown at N20 in FIG. 17A, the MPU first sets a column start address CSA and a page (row) start address PSA in a display area 210 and issues a writing start command. Accordingly, the column address is incremented automatically, as denoted at N21. Additionally, when the column address goes beyond the address (column end address) existing at the right end portion of the display area 210, the MPU issues a return command and a writing start command, as shown at N22. Whereupon, as shown at N23, the column address is returned to the column start address CSA and the page (row) address is incremented by 1. Additionally, the column address is incremented automatically, as shown at N24, and when the column address goes beyond the address existing at the right end portion of the display area 210, the MPU again issues a return command and a writing start command.

As obvious from FIG. 17A, according lo this conventional technique, it is necessary that the MPU be required to issue the return command and the writing start command whenever the column address goes beyond the address existing at the right end portion of the display area 210. In consequence, the processing load on the MPU becomes excessive.

Figure 17B:
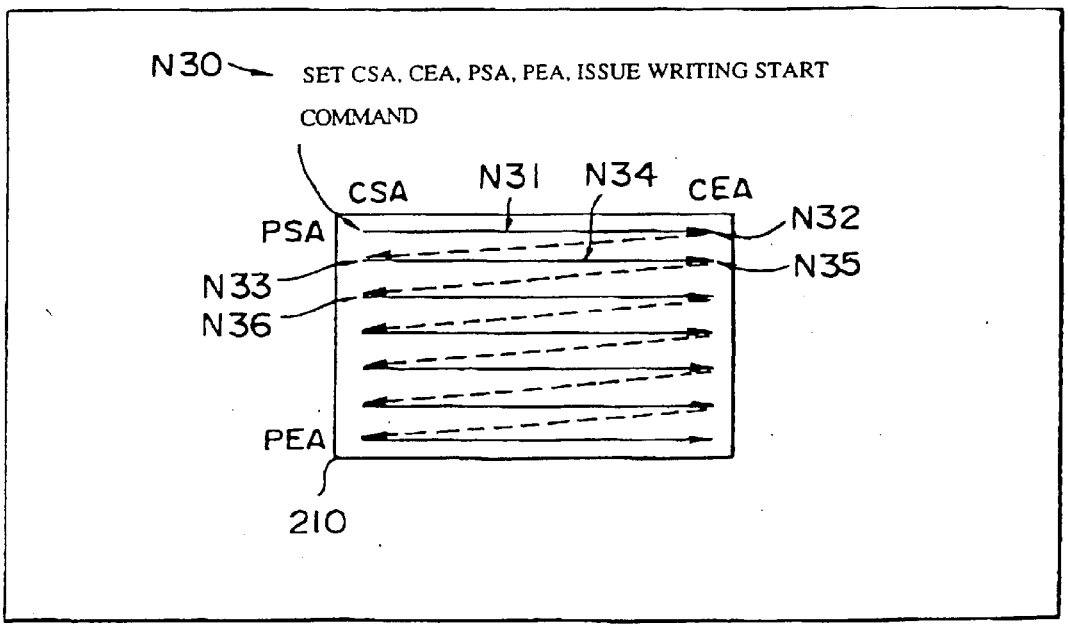
FIG. 17B is an illustration for describing a rewriting method according to this embodiment.

Therefore, this embodiment employs a method shown in FIG. 17B.

That is, as shown at N30 in FIG. 17B, the MPU sets a column start address CSA, a column end address CEA, a page start address PSA and a page end address PEA and issues a writing start command. Incidentally, it is also possible to set only the CSA and the CEA without setting the PSA and the PEA, or to set only the PSA and the PEA without setting the CSA and the CEA.

Accordingly, the column address is automatically incremented as shown at N31. Additionally, when, as shown at N32, the column address goes beyond the column end address CEA, as shown at N33, the column address is automatically returned to the column start address CSA, and the page address is automatically incremented by 1. Still additionally, as shown at N34, the column address is automatically incremented, and when, as shown at N35, the column address goes beyond the column end address CEA, as shown at N36, the column address is returned to the column start address CSA and the page address is incremented by 1.

As described above, according to this embodiment, if only the MPU first sets the CSA, the CEA, the PSA and the PEA and issues the writing start command as shown at N30, there is no need to issue the return command or the writing start command shown at N22 in FIG. 17A afterwards. Accordingly, the processing load on the MPU in rewriting the display data in the display area 210 can be softened considerably as compared with the method shown in FIG. 17A.

Moreover, a detailed description will be given hereinbelow of the method shown in FIG. 17B.

Figure 18:
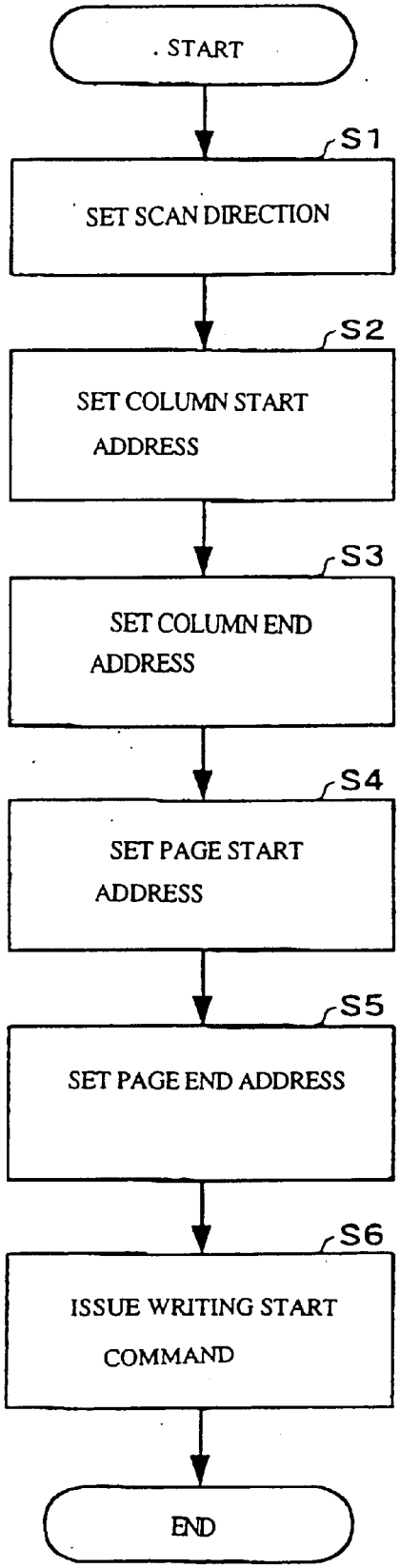
FIG. 18 is a flow chart showing a processing flow of an MPU for when display data in a specified display area is rewritten.

FIG. 18 is a flow chart showing a processing flow in the MPU to be conducted in rewriting display data in a display area.

First of all, the MPU sets a scanning direction (in this case, a column direction) (step S1).

Subsequently, the MPU sets a column start address (144 in FIG. 16) and a column end address (175 in FIG. 16) (steps S2 and S3), and further sets a page start address (4 in FIG. 16) and a page end address (7 in FIG. 16) (steps S4 and S5). Additionally, the MPU issues a command for the writing of display data in the RAM (step S6). The continuous writing of the display data in the RAM starts in this way.

Figure 19:
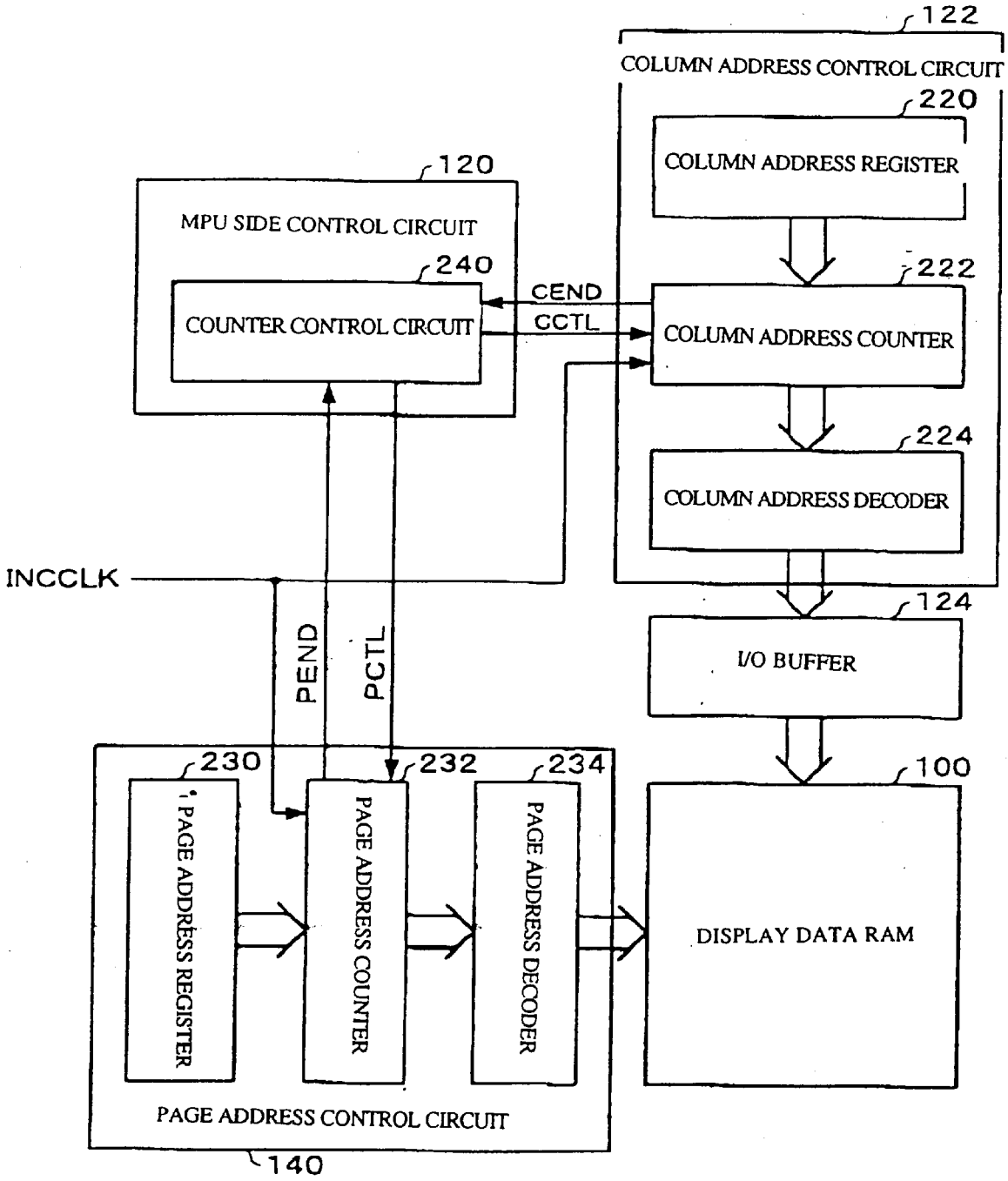
FIG. 19 is a block diagram showing concrete configurations of a column address control circuit, a page address control circuit and an MPU side control circuit.

FIG. 19 is a block diagram showing detailed examples of configurations of the column address control circuit 122, the page address control circuit 140 and the MPU side control circuit 120.

The column address control circuit 122 includes a column address register 220, a column address counter 222 and a column address decoder 224.

The column address register 220 holds a column start address and a column end address set by the MPU. The column address counter 222 increments successively the column address on the basis of an increment clock INCCLK. The column address decoder 224 decodes and outputs the column address incremented by the column address counter 222.

The page (row) address control circuit 140 includes a page address register 230, a page address counter 232 and a page address decoder 234.

The page address register 230 holds the page start address and the page end address set by the MPU. The page address counter 232 increments successively the page address on the basis of the increment clock INCCLK. The page address decoder 234 decodes and outputs the page address incremented by the page address counter 232.

The MPU side control circuit 120 includes a counter control circuit 240. This counter control circuit 240 controls the column address increment operation in the column address counter 222 and the page address increment operation in the page address counter 232.

Figure 20:
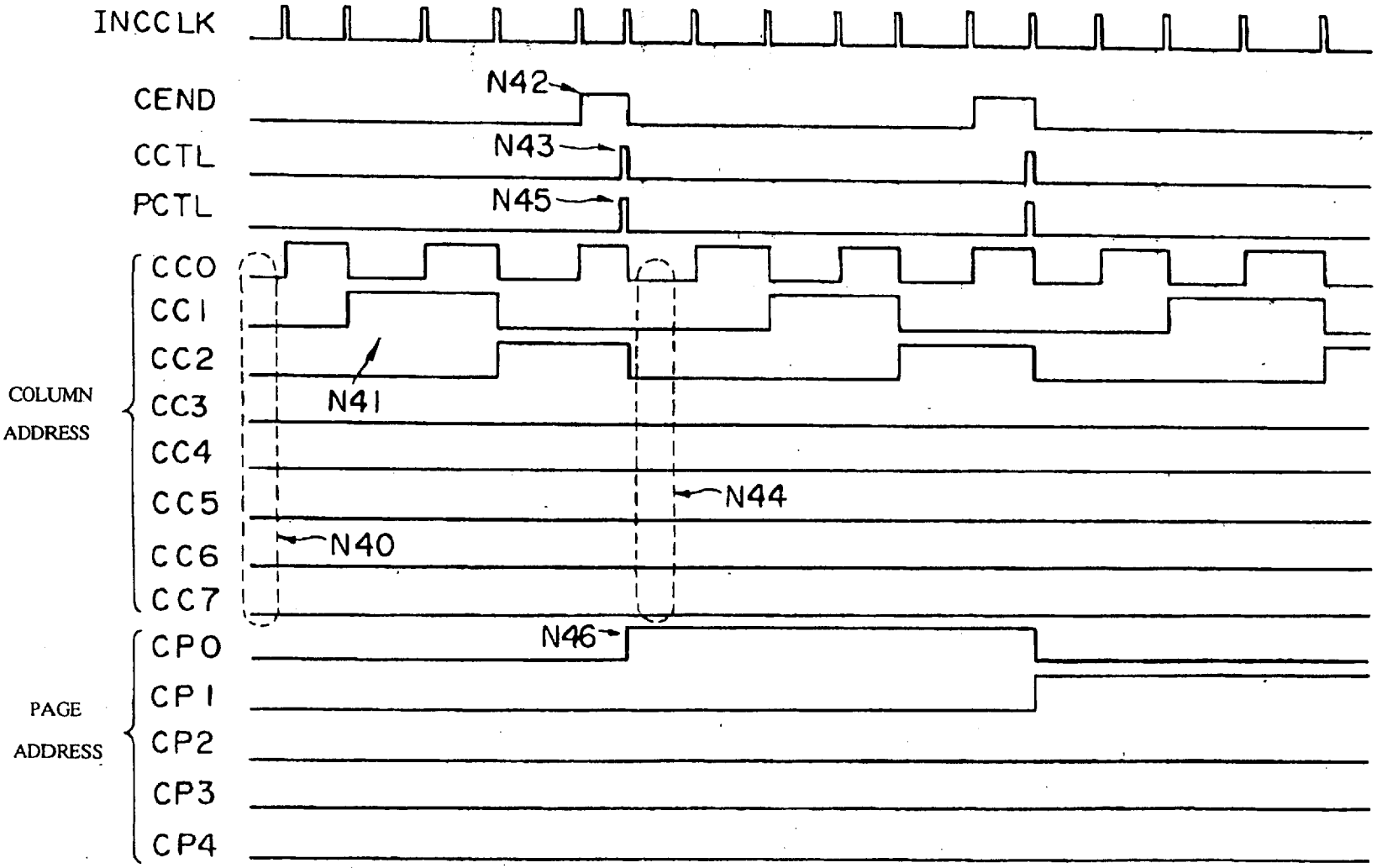
FIG. 20 is a timing chart for explaining operations of the circuits shown in FIG. 19.

Secondly, referring to the timing chart of FIG. 20, a description will be hereinbelow of the operations of the circuits shown in FIG. 19.

First, the column address counter 222 loads the column start address from the column address register 220 thereinto. In FIG. 20, as shown at N40, [00000000] is loaded thereinto.

Subsequently, as shown at N41, the column address counter 222 successively increments the column address on the basis of the increment clock INCCLK.

Furthermore, when the column address reaches the value of the column end address+1 (when going beyond the column end address), the column address counter 222 makes an end signal CEND active. Whereupon, when receiving this end signal CEND, the counter control circuit 240 makes active a control signal CCTL to be outputted to the column address counter 222, as shown at N43. Accordingly, the column address is reset to the column start address, as shown at N44.

Still furthermore, upon receipt of the end signal CEND, the counter control circuit 240 activates a control signal PCTL to be outputted to the page address counter 232, as shown at N45. In consequence, the page address is incremented by 1, as shown at N46. The repetition of the above-described operation enables the rewriting of the display data in the display area.

Incidentally, although the above description relates to the case in which the scanning direction is set to the column direction, this embodiment also allows that the scanning direction is set to the page direction. In this case, the operation is as follows.

That is, the page address counter 232 successively increments the page address loaded, on the basis of the increment clock INNCLK. Furthermore, when the page address reaches the value of the page end address+1, the page address counter 232 makes an end signal PEND active. Thereupon, a control signal PCTL becomes active and the page address is reset to the page start address, while the CCTL becomes active and the column address is incremented by 1. Repeating the above-described operation enables the rewriting of the display data in the display area.

Figure 21:
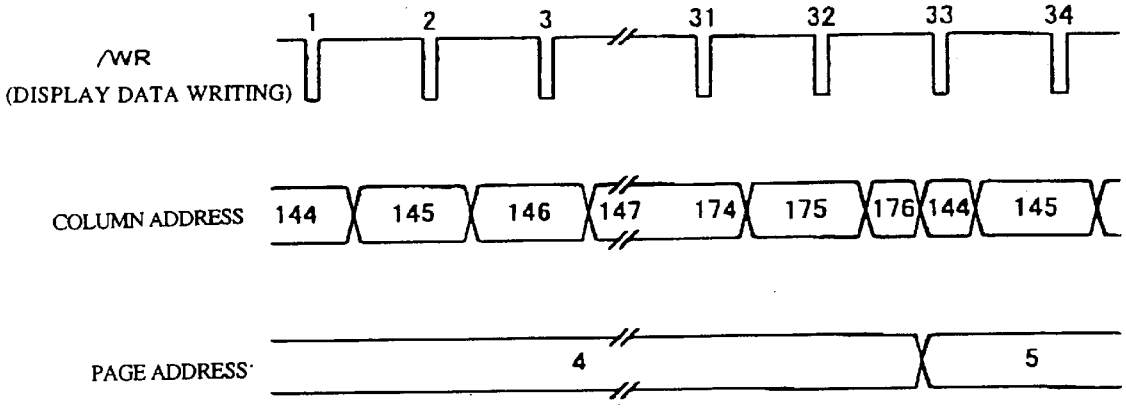
FIG. 21 is an illustration of variations of a column address and a page address, which occur at the rewriting of a display area.

As stated above, according to this embodiment, the access operation (write operation, read operation) to the display area 210, shown in FIG. 16, is realizable without increasing the processing load on the MPU. FIG. 21 shows variations of the column address and the page address in writing the display data in the display area 210, as shown in FIG. 16.

12. Low Power Consumption Operation

In this embodiment, an MPU chip select signal (terminal) /CS is connected in common to a plurality of signal line drivers. Additionally, as shown in FIGS. 3A, 3B and 16, also in the case of using a plurality of signal line drivers, the column address can be managed as continuous addresses. Accordingly, there is no need to pay attention to the use of the plurality of signal line drivers, an easy-to-use configuration is obtainable.

However, at a specific point of time, the signal line driver, having the RAM the MPU gains access to, is only one. For example, in FIG. 22, in the case in which the MPU 60 has access to the RAM 100 of the signal line driver 22, the other signal line drivers 24, 26 and 28 are not concerned and the RAMs 100 of these signal line drivers 24, 26 and 28 do not undergo the access. However, also in this case, one word line of the RAM 100 of each of the signal line drivers 24, 26 and 28 is in an active condition so that the so-called idle writing takes place. Hence, the sections which are not required originally to work are put into operation, which leads to wasteful power consumption. Accordingly, although the signal line driver containing the RAM is used, this configuration has a disadvantage in view of the low power consumption operation.

Figure 22:
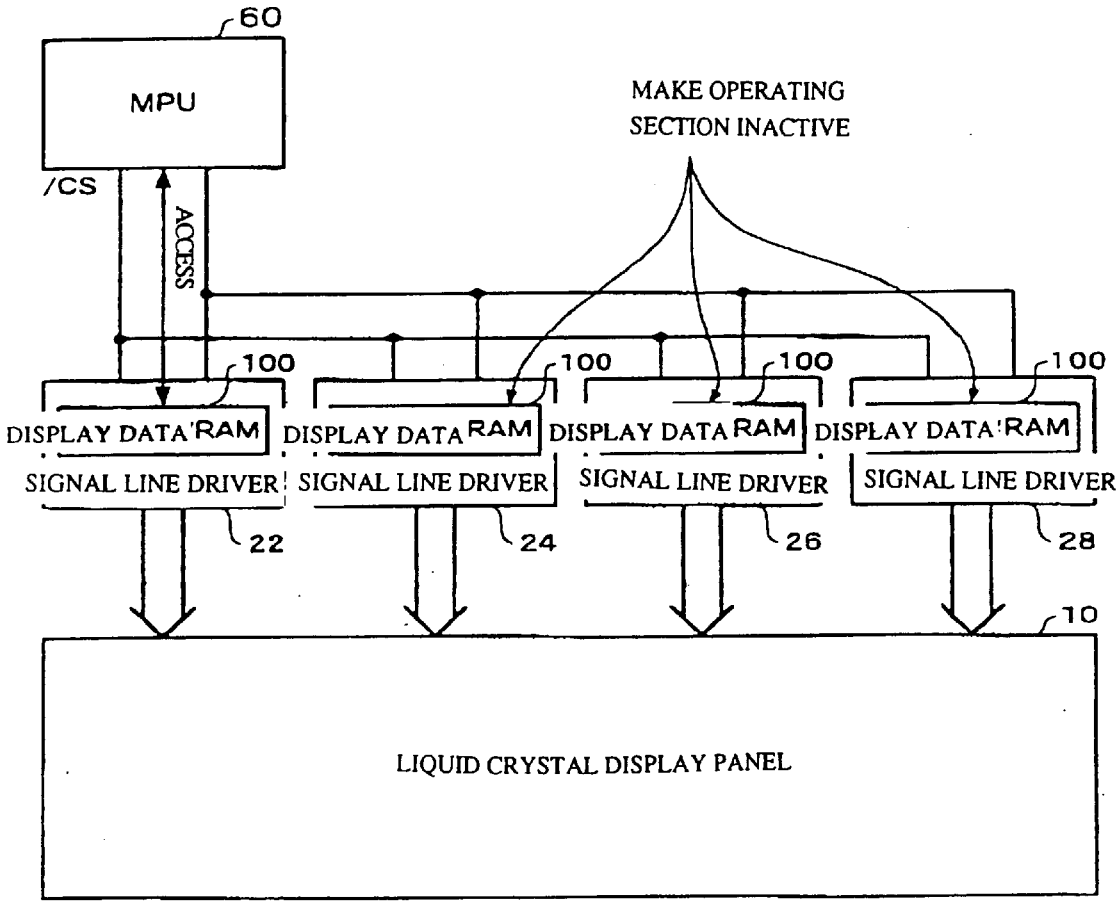
FIG. 22 is an illustration for explaining a method of deactivating an operating section concerned with a RAM of an unrelated signal line driver.

For this reason, according to this embodiment, as FIG. 22 shows, for example, in the case in which the MPU gains access to the RAM 100 of the signal line driver 22, in each of the other signal line drivers 24, 26 and 28, the operating section related to the access operation to the RAM 100 is made inactive. In this way, the idle writing in the RAM 100 of each of the signal line drivers 24, 26 and 28 is preventable, thus realizing the low power consumption operation.

More concretely, the low power consumption operation is realized according to the following method.

Figure 23:
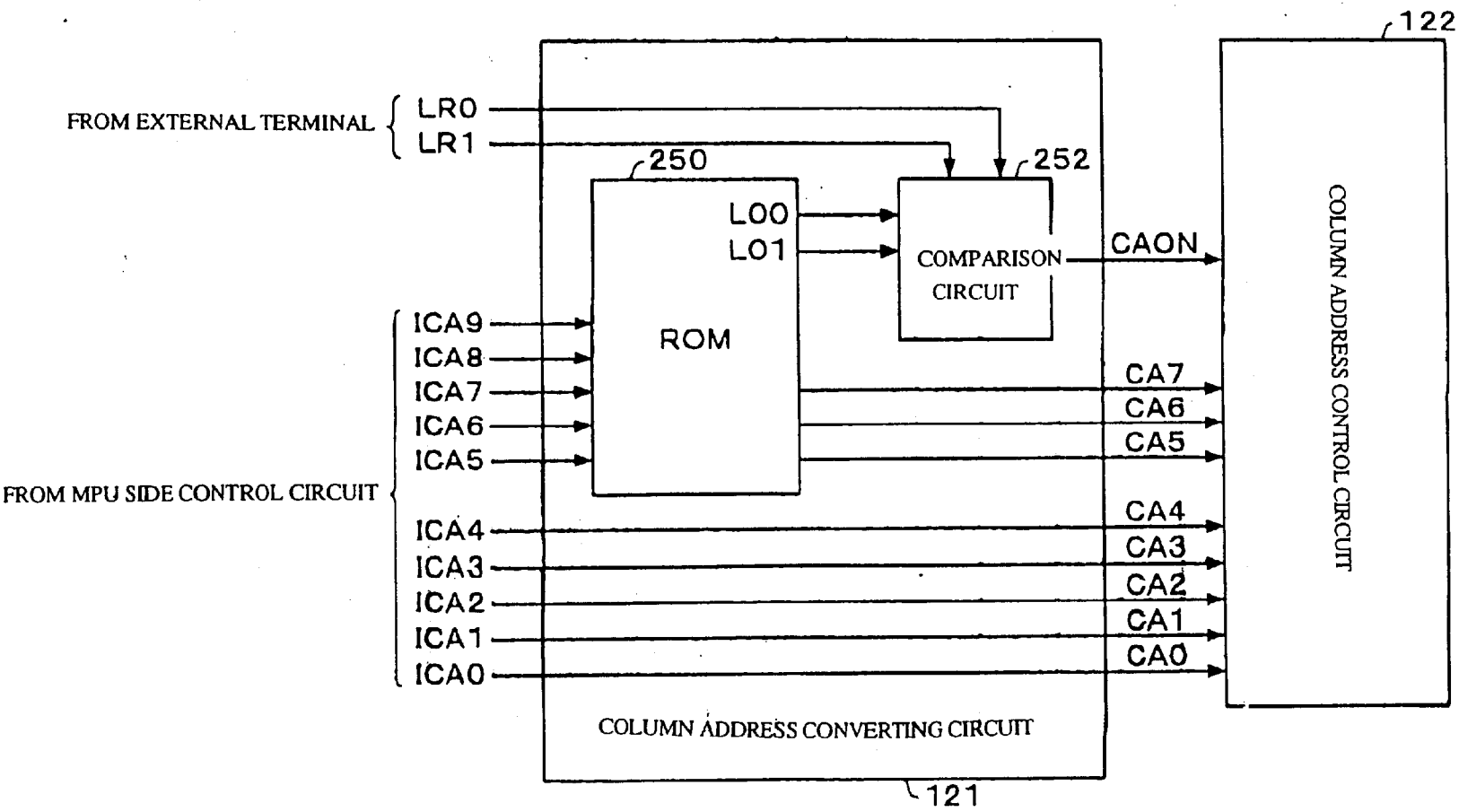
FIG. 23 is a block diagram showing a column address converting circuit.

FIG. 23 is a block diagram showing a concrete configuration of the column address converting circuit 121, shown in FIG. 2. As FIG. 23 shows, the column address converting circuit 121 receives a 10-bit address ICA[0:9] from the MPU side control circuit 120 and 2-bit signals LR0 and LR1 from the external terminal (see FIGS. 1 and 2).

In this case, the address ICA[0:9] is a 10-bit signal by which the MPU can manage the column addresses [0 to 639]. Furthermore, each of the LR0 and LR1 is a signal to be taken for using properly a maximum of four signal line drivers, as described with reference to FIGS. 1 and 2.

The column address converting circuit 121 is for converting the 10-bit address ICA[0:9] into an 8-bit relative address CA[0:7] on the basis of these ICA[0:9] and LR0 and LR1, and it outputs the relative address CA[0:7]. Additionally, in the case in which the RAM of the relevant signal line driver is accessed, a control signal CAON which becomes active is also outputted.

More concretely, as shown in FIG. 23, the column address converting circuit 121 includes an ROM 250 and a comparison circuit 252. Furthermore, of the ICA[0:9], the ICA [5:9] forming the address of the five upper bits is inputted to the ROM 250. The ROM 250 performs the conversion, shown in FIG. 25, on the basis of this 5-bit address IC[5:9] to output a 3-bit address CA[5:7].

In addition, the ROM 250 makes a decision, on the basis of the inputted upper 5-bit address ICA[5:9], as to which signal line driver that address is for. If that address is for the first-stage signal line driver, signals (LO0, LO1) are set at (L, L) levels before outputted. Likewise, if that address corresponds to the second-stage, third-stage or fourth-stage signal line driver, the signals (LO0, LO1) are set at (L, H), (H, L) or (H, H) levels before outputted. Furthermore, the comparison circuit 252 compares the signals LO0 and LO1 from the ROM 250 with signals LR0 and LR1 from the external terminal and, only when they coincide with each other, makes the control signal CAON active. In this way, only when the designated address is an address for the relevant signal line driver, the control signal CAON becomes active.

Figure 25:
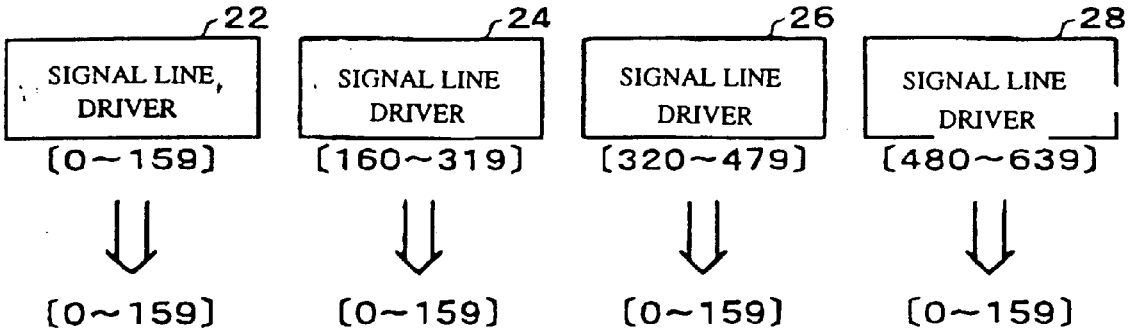
FIG. 25 is an illustration for explaining a method of converting a column address into a relative address.

FIG. 25 shows the conversion of the address ICA[0:9] into the relative address CA[0:7], with this conversion being made as shown in FIG. 24.

That is, in the case of the first-stage signal line driver 22, the subtraction of 0 from the addresses [0 to 159] is made so that the addresses [0 to 159] are converted into the addresses [0 to 159]. Furthermore, for the second-stage signal line driver 24, the subtraction of 160 from the addresses [160 to 319] is made for the conversion into the addresses [0 to 159]. Still furthermore, for the third-stage signal line driver 26, the subtraction of 320 from the addresses [320 to 479] is made for the conversion into the addresses [0 to 159]. Moreover, for the fourth-stage signal line driver 28, the subtraction of 480 from the addresses [480 to 639] is made for the conversion into the addresses [0 to 159]. That is, in all the signal line drivers 22, 24, 26 and 28, the output addresses, from the column address converting circuit 121, always come to [0 to, 159].

This contributes to considerable reduction of the circuit scale of the column address decoder (ADEC in FIG. 5) included in the column address control circuit 120.

That is, in the case of the conventional technique disclosed in Japanese Unexamined Patent Publication No. 10-105505, an 8-bit address CA[0:7] and signals LR0 and LR1 are inputted to a column address decoder. Accordingly, each of the column address decoders must decode the addresses in the range of [0 to 639]; therefore, the address decoder is required to have an extremely large circuit scale.

On the other hand, according to this embodiment, each of the column address decoders simply involves decoding the addresses in the range of [0 to 159]. In consequence, the circuit scale of the column address decoder is reducible to approximately 1/4 of that of the column address decoder in the above-mentioned conventional technique. At this time, in this embodiment, the ROM 250, shown in FIG. 23, is needed additionally to increase the circuit scale accordingly. However, the circuit scale reduction of 160 column address decoders to approximately 1/4 can sufficiently offset the increase in the circuit scale resulting from the installation of the ROM 250.

In addition, this embodiment realizes the aforesaid low power consumption operation by effectively utilizing the control signal CAON, outputted from the column address converting circuit 121.

That is, this embodiment produces the control signal CALCTL in FIG. 5, using the control signal CAON. When this control signal CALCTL becomes an H level, a P-type transistor TP of a transfer gate TR turns off, and the output of the column address decoder ADEC is validated. On the other hand, when the control signal CALCTL turns to an L level, the P-type transistor TP of the transfer gate TR turns on, and the output of the column address decoder ADEC is set compulsively at the H level. That is, the output of the column address decoder ADEC is invalidated.

Furthermore, in this embodiment, in the signal line driver (for example, the signal line driver 22 in FIG. 22) whose RAM is on the access thereto, the control signal CAON becomes the H level (active), and the control signal CALCTL also becomes the H level. Hence, the output of the column address decoder ADEC is validated, thereby permitting the access to the RAM.

On the other hand, in the unrelated signal line driver (for example, the signal line driver 24, 26 or 28), the control signal CAON becomes the L level (inactive), and the control signal ALCTL also becomes the L level. Hence, the output of the column address decoder ADEC is invalidated at all times, and the column switch CLS takes the off condition at all times. As a result, it is possible to suppress the current consumption of the unrelated signal line driver, thereby realizing the low power consumption operation.

Moreover, this embodiment uses the control signal CAON to prevent the word lines in the unrelated signal line drivers from becoming active. More concretely, a selection signal given to the word line is created with a page address generated from the page address control circuit 140 and a pulse signal outputted from the RAM control circuit 170 in FIG. 2. Additionally, in this embodiment, when the control signal CAON is at the L level (inactive), the aforesaid pulse signal is fixed to the L level (inactive). Whereupon, in the unrelated signal line driver, the word lines do not become active. Accordingly, the current consumption of the unrelated signal line drivers can be restrained, and the lower power consumption operation is realized.

The present invention is not limited to this embodiment, but the invention covers various modifications which do not constitute departures from the spirit and scope of the invention.

For example, in the case of the invention in which a memory access monitor signal is outputted to an external terminal or the invention in which an access operation to a memory is started on condition of the completion of a precharge operation, the arbitration in an arbitration circuit is not limited to the methods described above with reference to FIGS. 8 and 9. That is, it is also acceptable to perform the arbitration according to the method disclosed in Japanese Unexamined Patent Publication No. 10-105505.

In addition, although the description of this embodiment has been given, as an example, in the case of a drive unit in which a displaying section is driven by an MLS drive, this invention is also applicable to a drive unit which does not employ the MLS drive or a drive unit for driving a display section other than a liquid crystal display panel.

What is claimed is:

1. A drive unit which receives display data from a microprocessor unit to drive a displaying section, comprising:

a memory for storing display data to be used for image display in said displaying section;

an arbitration circuit for receiving a first access request forming a request for access to said memory according to a command from said microprocessor unit and a second access request forming a request for access to said memory according to a displaying operation in said displaying section to arbitrate in priority between said first and second access requests for starting an access operation to said memory according to the preferential one of said first and second access requests; and a circuit for outputting, to an external terminal, a memory access monitor signal for monitoring an access condition to said memory to which an access operation starts in accordance with the arbitration of said arbitration circuit.

2. A drive unit according to claim 1, wherein, when a competition arises between said first and second access requests, said memory access monitor signal becomes active for at least a processing time of a first access operation according to said first access request plus a processing time of a second access operation according to said second access request.

3. A drive unit according to claim 1, wherein said memory access monitor signal is a signal to be outputted through said external terminal to a wait terminal of said microprocessor unit.

4. A drive unit according to claim 1, further comprising:

a first control circuit for outputting a signal indicative of said first access request;

a second control circuit for outputting a signal representative of said second access request; and a third control circuit for outputting a fist operation end signal which becomes active at the completion of a first access operation according to said first access request and a second operation end signal which becomes active at the completion of a second access operation according to said second access request, wherein said memory access monitor signal is produced as a logical sum of a signal which becomes active when said first access request signal becomes active while becoming inactive when said first operation end signal becomes active and a signal which becomes active when said second access request signal becomes active while becoming inactive when said second operation end signal becomes active.

5. A drive unit which receives display data from a microprocessor unit to drive a displaying section, comprising:

memory for storing display data to be used for image display in said displaying section;

an arbitration circuit for receiving a first access request forming a request for access to said memory according to a command from said microprocessor unit and a second access request forming a request for access to said memory according to a displaying operation in said displaying section to arbitrate in priority between said first and second access requests for starting an access operation to said memory according to the preferential one of said first and second access requests;

a memory control circuit for conducting a precharge operation for said memory before the start of said access operation to the memory; and decision means for making a decision as to whether or not said memory precharge operation reaches completion, wherein said arbitration circuit starts said memory access operation according to one of said first and second access requests on condition that the decision is made to the completion of said memory precharge operation.

6. A drive unit according to claim 5, wherein said memory control circuit makes a precharge monitor signal active when the decision is made that said memory precharge operation reaches completion, while said arbitration circuit starts said memory access operation according to said first and second access requests on condition that said precharge monitor signal becomes active.

7. A drive unit according to claim 5, wherein said decision means includes a dummy memory for making a decision as to whether or not said memory precharge operation reaches completion, and said precharge signal is produced by a logical sum of signals on first and second bit lines in said dummy memory.

8. A drive unit which receives display data from a microprocessor unit to drive a displaying section, comprising:

a memory for storing display data to be used for image display in said displaying section; and an address control circuit, when said microprocessor unit sets a first start address and a first end address related to a first address, forming one address of a column address and a row address of said memory, for access to a specified display area of said memory and starts an access operation to said memory, automatically varying said first address to return said first address to said first start address on condition that said first address goes beyond said first end address and further varying a second address forming the other address of said column address and said row address.

9. A drive unit according to claim 8, further comprising a plurality of drive units, wherein when an access operation to a memory of a selected drive unit takes place, an operating section of each of the other of the plurality of drive units used in an access operation to a memory of the other drive units is made inoperative.

10. A drive unit according to claim 9, wherein said plurality of drive units include a plurality of column address converting circuits, respectively, and include a plurality of column address control circuits, respectively, with each of said a plurality of column address converting circuits converting a column address sec by said microprocessor unit into a relative address to output the converted relative address to the succeeding column address control circuit and further outputting a control signal for validating or invalidating an output of a column address decoder said column address control circuit includes.

11. A drive unit which receives display data from a microprocessor unit to drive a displaying section, comprising:

a memory for storing said display data from said microprocessor unit; and an arbitration circuit for receiving a first access request forming a request for access to said memory according to a command from said microprocessor unit and a second access request forming a request for access to said memory according to a displaying operation in said displaying section to arbitrate in priority between said first and second access requests for starting an access operation to said memory according to one of said first and second access requests, wherein, when a competition occurs between said first and second access requests, said arbitration circuit gives priority to said first access request.

12. A drive unit according to claim 11, wherein, when receiving said first access request after the reception of said second access request but before the completion of a second access operation according to said second access request, said arbitration circuit ceases said second access operation while starting a first access operation according to said first access request, and Her resumes said second access operation after the completion of said first access operation.

13. A drive unit according to claim 12, wherein said arbitration circuit includes a holding circuit for holding reservation information about the resumption of said second access operation when receiving said first access request after the reception of said second access request but before the completion of said second access operation according to said second access request, and said arbitration circuit resumes said second access operation on the basis of said reservation information, said holding circuit retains, after the completion of said first access operation.

14. A drive unit according to claim 11, further comprising a plurality of drive units, wherein when an access operation to a memory of a selected drive unit takes place, an operating section of each of the other of the plurality of drive units used in an access operation to a memory of the other drive units is made inoperative.

15. A drive unit according to claim 14, wherein said plurality of drive units include a plurality of column address converting circuits, respectively, and include a plurality of column address control circuits, respectively, with each of said a plurality of column address converting circuits converting a column address set by said microprocessor unit into a relative address to output the converted relative address to the succeeding column address control circuit and firer outputting a control signal for validating or invalidating an output of a column address decoder said column address control circuit includes.

16. A liquid crystal device, comprising:

a drive unit which receives display data from a microprocessor unit to drive a displaying section, the drive unit comprising:

a memory for storing display data to be used for image display in said displaying section;

an arbitration circuit for receiving a first access request forming a request for access to said memory according to a command from said microprocessor unit and a second access request forming a request for access to said memory according to a displaying operation in said displaying section to arbitrate in priority between said first and second access requests for starting an access operation to said memory according to the preferential one of said first and second access requests; and a circuit for outputting, to an external terminal, a memory access monitor signal for monitoring an access condition to said memory to which an access operation starts in accordance with the arbitration of said arbitration circuit; and a liquid crystal display panel to be driven by said drive unit.

17. A drive unit according to claim 16, wherein, when a competition arises between said first and second access requests, said memory access monitor signal becomes active for at least a processing time of a first access operation according to said first access request plus a processing time of a second access operation according to said second access request.

18. A drive unit according to claim 16, wherein said memory access monitor signal is a signal to be outputted through said external terminal to a wait terminal of said microprocessor unit.

19. A drive unit according to claim 16, further comprising:

a first control circuit for outputting a signal indicative of said first access request;

a second control circuit for outputting a signal representative of said second access request; and a third control circuit for outputting a first operation end signal which becomes active at the completion of a first access operation according to said first access request and a second operation end signal which becomes active at the completion of a second access operation according to said second access request, wherein said memory access monitor signal is produced as a logical sum of a signal which becomes active when said first access request signal becomes active while becoming inactive when said first operation end signal becomes active and a signal which becomes active when said second access request signal becomes active while becoming inactive when said second operation end signal becomes active.

20. A liquid crystal device, comprising:

a drive unit which receives display data from a microprocessor unit to drive a displaying section, the drive unit comprising:

a memory for storing display data to be used for image display in said displaying section;

an arbitration circuit for receiving a first access request forming a request for access to said memory according to a command from said microprocessor unit and a second access request forming a request for access to said memory according to a displaying operation in said displaying section to arbitrate in priority between said first and second access requests for starting an access operation to said memory according to the preferential one of said first and second access requests;

a memory control circuit for conducting a precharge operation for said memory before the start of said access operation to the memory; and decision means for making a decision as to whether or not said memory precharge operation reaches completion, wherein said arbitration circuit starts said memory access operation according to one of said first and second access requests on condition that the decision is made to the completion of said memory precharge operation; arid a liquid crystal display panel to be driven by said drive unit.

21. A drive unit according to claim 20, wherein said memory control circuit makes a precharge monitor signal active when the decision is made that said memory precharge operation reaches completion, while said arbitration circuit starts said memory access operation according to said first and second access requests on condition that said precharge monitor signal becomes active.

22. A drive unit according to claim 20, wherein said decision means includes a dummy memory for making a decision as to whether or not said memory precharge operation reaches completion, and said precharge signal is produced by a logical sum of signals on first and second bit lines in said dummy memory.

23. A liquid crystal device, comprising:

a drive unit which receives display data from a microprocessor unit to drive a displaying section, the drive unit comprising:

a memory for storing display data to be used for image display in said displaying section; and an address control circuit, when said microprocessor unit sets a first start address and a first end address related to a first address, forming one address of a column address and a row address of said memory, for access to a specified display area of said memory and starts an access operation to said memory, automatically varying said first address to return said first address to said first start address on condition that said first address goes beyond said first end address and further varying a second address forming the other address of said column address and said row address; and a liquid crystal display panel to be driven by said drive unit.

24. A drive unit according to claim 23, further comprising a plurality of drive units, wherein when an access operation to a memory of a selected drive unit takes place, an operating section of each of the other of the plurality of drive units used in an access operation to a memory of the other drive units is made inoperative.

25. A drive unit according to claim 24, wherein said plurality of drive units include a plurality of column address converting circuits, respectively, and include a plurality of column address control circuits, respectively, with each of said a plurality of column address converting circuits converting a column address set by said microprocessor unit into a relative address to output the converted relative address to the succeeding column address control circuit and further outputting a control signal for validating or invalidating an output of a column address decoder said column address control circuit includes.

26. A liquid crystal device, comprising:

a drive unit which receives display data from a microprocessor unit to drive a displaying section, the drive unit comprising:

a memory for storing said display data from said microprocessor unit; and an arbitration circuit for receiving a first access request forming a request for access to said memory according to a command from said microprocessor unit and a second access request forming a request for access to said memory according to a displaying operation in said displaying section to arbitrate in priority between said first and second access requests for starting an access operation to said memory according to one of said first and second access requests, wherein, when a competition occurs between said first and second access requests, said arbitration circuit gives priority to said first access request; and a liquid crystal display panel to be driven by said drive unit.

27. A drive unit according to claim 26, wherein, when receiving said first access request after the reception of said second access request but before the completion of a second access operation according to said second access request, said arbitration circuit ceases said second access operation while starting a first access operation according to said first access request, and further resumes said second access operation after the completion of said first access operation.

28. A drive unit according to claim 27, wherein said arbitration circuit includes a holding circuit for holding reservation information about the resumption of said second access operation when receiving said first access request after the reception of said second access request but before the completion of said second access operation according to said second access request, and said arbitration circuit resumes said second access operation on the basis of said reservation information, said holding circuit retains, after the completion of said first access operation.

29. A drive unit according to claim 26, further comprising a plurality of drive units, wherein when an access operation to a memory of a selected drive unit takes place, an operating section of each of the other of the plurality of drive units used in an access operation to a memory of the other drive units is made inoperative.

30. A drive unit according to claim 29, wherein said plurality of drive units include a plurality of column address converting circuits, respectively, and include a plurality of column address control circuits, respectively, with each of said a plurality of column address converting circuits converting a column address set by said microprocessor unit into a relative address to output the converted relative address to the succeeding column address control circuit and further outputting a control signal for validating or invalidating an output of a column address decoder said column address control circuit includes.

* * * * *